US009108237B1

(12) United States Patent
Macaulay

(10) Patent No.: US 9,108,237 B1
(45) Date of Patent: Aug. 18, 2015

(54) DETERMINING, CALIBRATING, AND EXPORTING K-FACTORS AND BEND ALLOWANCE

(71) Applicant: Robert Macaulay, Roswell, GA (US)

(72) Inventor: Robert Macaulay, Roswell, GA (US)

( * ) Notice: Subject to any disclaimer, the term of this patent is extended or adjusted under 35 U.S.C. 154(b) by 0 days.

(21) Appl. No.: 14/228,696

(22) Filed: Mar. 28, 2014

Related U.S. Application Data

(63) Continuation of application No. 12/837,768, filed on Jul. 16, 2010, now Pat. No. 8,683,834.

(60) Provisional application No. 61/226,104, filed on Jul. 16, 2009.

(51) Int. Cl.
*B21D 5/00* (2006.01)

(52) U.S. Cl.
CPC ..... *B21D 5/006* (2013.01); *B21D 5/004* (2013.01)

(58) Field of Classification Search
CPC ..... B21D 5/004; B21D 5/006; B21D 5/02
USPC ..... 72/17.3, 18.9, 20.1, 31.1, 31.11, 72/308–310, 389.3
See application file for complete search history.

(56) References Cited

U.S. PATENT DOCUMENTS 7,249,478 B2 7/2007 Takehara et al.

FOREIGN PATENT DOCUMENTS

EP 1961502 A2 * 8/2008

OTHER PUBLICATIONS

U.S. Office Action mailed on Jan. 3, 2013 in U.S. Appl. No. 12/837,768.
U.S. Office Action mailed on Jun. 25, 2013 in U.S. Appl. No. 12/837,768.
U.S. Notice of Allowance mailed on Nov. 7, 2013 in U.S. Appl. No. 12/837,768.

* cited by examiner

*Primary Examiner* — Debra Sullivan
(74) *Attorney, Agent, or Firm* — Hartman & Citrin LLC

(57) ABSTRACT

The present disclosure is directed to systems and methods for determining and calibrating a K-factor for material and to methods and systems for calibrating forming devices, forming device controls, and/or forming device components. The disclosed systems and methods can dynamically provide exact and calibrated values for the parameters needed to produce correct and accurate flat patterns based on any type of material or any tooling combination. As such, the systems and methods of the present disclosure can be used to achieve a first run perfect or near-perfect part capability that does not currently exist.

20 Claims, 14 Drawing Sheets

DETERMINING, CALIBRATING, AND EXPORTING K-FACTORS AND BEND ALLOWANCE

CROSS-REFERENCE TO RELATED APPLICATIONS

This application is a continuation of U.S. patent application Ser. No. 12/837,768, entitled "Systems and Methods for Determining, Calibrating, and Exporting K-Factors Based on Measured Bend Radius," filed Jul. 16, 2010, now U.S. Pat. No. 8,683,834, which is incorporated by reference in its entirety. This application also claims priority to U.S. Provisional Patent Application No. 61/226,104, entitled "Systems and Methods for Determining, Calibrating, and Exporting K-Factors Based on Measured Bend Radius," filed Jul. 16, 2009, which is incorporated herein by reference in its entirety.

TECHNICAL FIELD

The present disclosure relates generally to forming devices, and, more particularly, to systems and methods for determining, calibrating, and exporting K-factors and bend allowance in forming devices and forming device controls.

BACKGROUND

When sheet metal or metal plate is formed on a press brake, the behavior of the material and the resulting bend profile are dependent on two key variables: the geometry of a tool or tooling used, and the strength and composition properties of the material being formed. This creates an almost infinite number of possible outcomes with respect to how the material will behave during bending. This possibility results in a frustrating and costly process every time a new material or tool combination is used.

Various methods are used to try to address this problem. There exist published tables of bend parameters that are based on a particular material's statistical strength properties, i.e., a bend allowance or K-factor table. One of these parameters together with a specified inside bend radius can be used to manually calculate how the part will behave, or may be employed in a CAD/CAM or 3D design and unfolding software system to "unfold" the part for purposes of planning the location of the desired part features, e.g., folds, bends, and the like. However, utilizing or creating K-factor tables involves an iterative process of trial bending and measurement that relies on the expertise and experience of the operator.

A blank for a part is cut, for example using a CNC plasma machine, a turret punch, laser, or other cutting or forming device. A test part is formed and measured. Depending on how close the selected bend parameter and radius is to the actual material, the finished part can be close to the correct size, or can be significantly larger or smaller than required. If the part is not close to the desired size, one or various parameters may need to be adjusted since there is more than one parameter that can be adjusted to reduce or eliminate the error. One may rely upon adjustment of two factors to control or adjust the finished form size of a part, i.e., the inside radius and either the bend allowance or the K-factor. The inside radius, the bend allowance, and the K-factor are related.

During adjustment of these parameters, the inside radius value is often manipulated to a less than accurate value simply because the inside radius is the easiest parameter to adjust. While such a parameter change does adjust the formed size of a part, the over-manipulation of the inside radius value can create additional problems. For example, while the finished part may be closer to the desired size, the inside radius used by the design system has been adjusted to an inaccurate value with respect to any mating parts. As such, the finished part may be formed within tolerance, but the mating parts will have to be adjusted to match the profile of the formed part—a step that further complicates the job of part design.

As such, in many manufacturing operations it takes several attempts to get a part correct. Even more attempts may be required to get a correct set of mating parts. This can result in significant hard costs lost to scrapped test material, lost machine time in cutting test parts, and labor costs since this process often involves two or more people. The end result of all of these difficulties is that prototype development can be the most costly part of production as prototype development generates no revenue, and must be done to provide a proof of performance capability in the contract manufacturing market and OEM's.

SUMMARY

The present disclosure is directed to systems and methods for determining and calibrating a K-factor and bend allowance for material, based upon measurement of bend radius. According to embodiments of the present disclosure, the disclosed systems and methods can dynamically provide exact and calibrated values for the parameters needed to produce correct and accurate flat patterns based on any type of material or any tooling combination. As such, the systems and methods of the present disclosure can be used to achieve a first run perfect part capability that does not currently exist. As such, the disclosed systems and methods can help provide performance not currently available in any system, and represents a significant leap over known systems.

The present disclosure includes systems and methods for providing an automatic and accurate measurement of the actual achieved inside radius of a formed part from a forming process performed using a press brake or other forming device.

The present disclosure also includes systems and methods for using the measured bend radius to calculate accurate neutral axis bend length, also known as the bend allowance, and the neutral axis radius using the measured inside radius generated using systems and methods disclosed herein, as well as pre- and post-formed dimensions of a calibration sample for any desired bend angle. The systems and methods are also useful for calculating bend deduction, particularly at a desired bend of angle 90°.

The present disclosure also includes systems and methods for calculating an accurate K-factor for the formed sample material, bend, and tooling combination based on the measured inside radius, neutral axis length, and neutral axis radius generated using systems and methods disclosed herein.

The present disclosure includes systems and methods for providing the calibrated formed part radius, the neutral axis/bend allowance, and the K-factor from material calibrations stored in a computer database directly to another source such as, for example, CNC control software. Providing these data can assist in allowing accurate part development and accurate backgauge programming. Additionally, through the use of portable computer media, direct computer-to-computer network export, or remote access to these data, the systems and methods disclosed herein can assist in allowing the calibrated neutral axis/bend allowance, the neutral axis radius, and the K-factor determined by the systems and methods disclosed herein to be provided to other systems. In some embodiments, the data generated and stored by systems and methods according to the present disclosure is accessed by or provided to outside computerized bending programs, 3D offline CAM/bending software, 3D software unfolding systems, 3D design systems, and other systems and devices.

The present disclosure includes systems and methods for providing direct input of the measured formed sample flange length data to a calibration utility or a CNC control, for example via a wired or wireless data link, to a computer control or software utility.

The present disclosure includes systems and methods for providing dynamic calibration of the CNC backgauge.

According to an embodiment of the present disclosure, a method for determining a K-factor for a sample material includes tracking, using a control system associated with a forming device, movement of a forming tool during a forming process occurring at the forming device. The method further includes determining the K-factor for the sample material based, at least partially, upon the movement of the forming tool.

According to another embodiment of the present disclosure, a forming device configured to determine a K-factor for a sample material includes a forming tool and a processor in communication with a memory. The processor is configured to execute computer readable instructions stored at the memory. Execution of the computer readable instructions by the processor can make the device operable to track movement of the forming tool during a forming process occurring at the forming device, and determine the K-factor for the sample material based, at least partially, upon the movement of the forming tool.

According to another embodiment of the present disclosure, a method for calibrating a forming device includes obtaining a dimension associated with a part formed at the forming device, calculating an error based, at least partially, upon the dimension, and calibrating the forming device to correct for the error.

DESCRIPTION

As required, detailed embodiments of the present disclosure are disclosed herein. It must be understood that the disclosed embodiments are merely exemplary of the disclosure that can be embodied in various and alternative forms, and combinations thereof. As used herein, the word "exemplary" is used expansively to refer to embodiments that serve as an illustration, specimen, model or pattern. The figures are not necessarily to scale and some features can be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Figure 1:
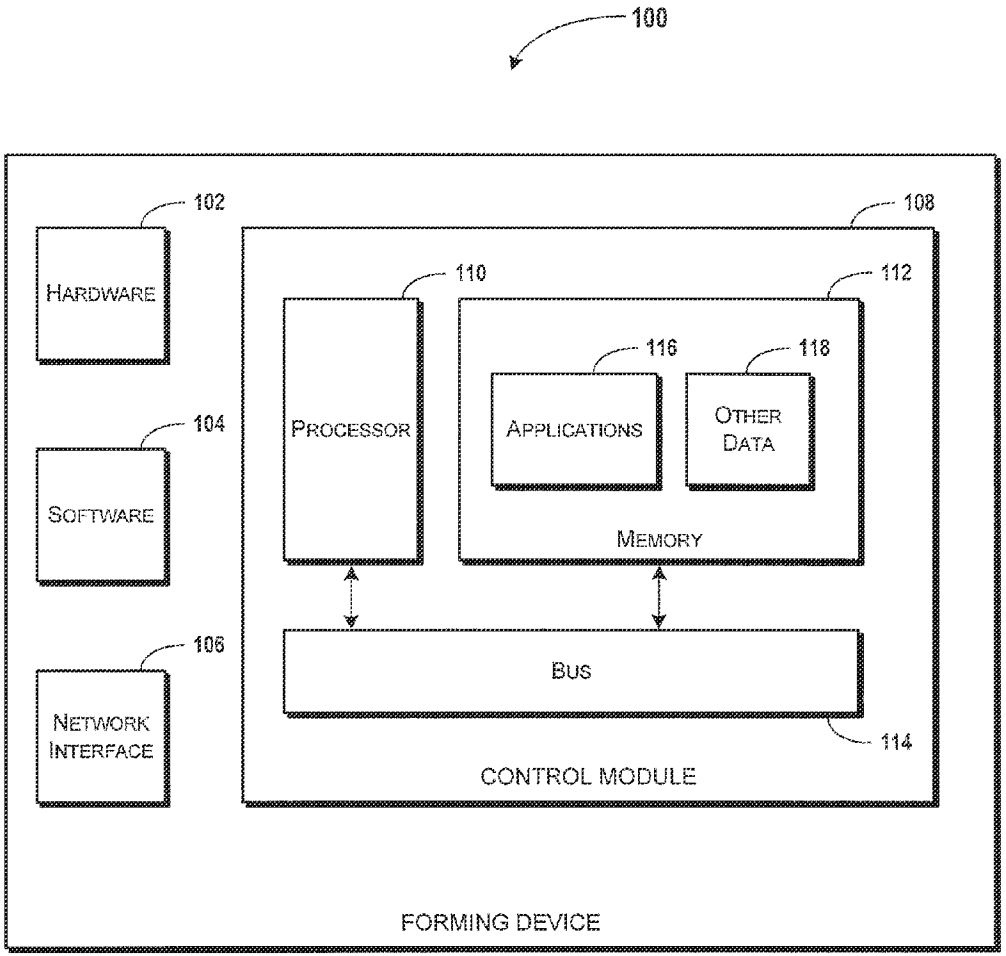
FIG. 1 illustrates a forming device, according to an exemplary embodiment of the present disclosure.

FIG. 1 schematically illustrates a forming device 100, according to an exemplary embodiment of the present disclosure. In the illustrated embodiment, the forming device 100 includes one or more hardware components 102 ("hardware"), one or more software components 104 ("software"), one or more network interfaces 106, and one or more control modules 108. Although connections are not shown between all of the elements in FIG. 1, the forming device 100 can be configured such that all of the elements can communicate with each other.

The hardware 102 can include hardware components of the forming device 100. As such, the hardware 102 can include, but is not limited to, one or more rams, one or more forming tools, one or more punches, one or more hydraulic mechanisms, one or more beds for supporting material, one or more backgauges, one or more manual gauges, one or more lower forming tools or dies, one or more servos, one or more motors, optical sensors, weight sensors, pressure sensors, presence sensors, conveyors, depth gauges, water lines, vacuum lines, bending tools, displays, cameras, safety mechanisms, combinations thereof, and the like.

The software 104 can include software components of the forming device 100. The software 104 can include, but is not limited to, applications, routines, subroutines, programs, computer-readable instructions, computer-executable instructions, and the like, for controlling various functions of the forming device 100. In some embodiments, the software 104 can include instructions that are executable by a processing system such as a processor or other circuitry to execute various functions associated with the forming device 100. In some embodiments, the software 104 can include bending applications for placing bends in a blank part, and K-factor determination software for calculating a K-factor based upon various measurements and data tracked and input into the forming device 100. As will be explained below, these and other applications or programs can be included in the control module 108, and can perform any of the K-factor determination steps and processes described in the specification and/or claims.

The network interface 106 can be operatively linked and in communication with one or more communications networks such as, for example, private networks, the Internet, cellular communications networks, wireless area networks, an intranet, other networks, combinations thereof, and the like. The network interface 106 can be used to pass determined K-factors, or other information, to a network device such as, for example, a database or server operating on the Internet or a local network, intranet, private network, and the like. It should be understood that the forming device 100 can be configured to communicate any desired information to another device via the network interface 106. For purposes of illustration, and not limitation, the desired information can include determined K-factors or bend allowances, backgauge calibration information, material springback data, operational statistics such as parts per minute or throughput, safety device data, and other information relating to the forming device 100, operation of the forming device 100, the product formed at the forming device 100, parts coming to the forming device 100, or other information relating to the operator associated with the forming device 100.

The control module 108 can include one or more processors 110, which can be operatively linked and in communication with one or more memory devices 112 via one or more data/memory busses 114. The processor 110 can execute computer-readable instructions, for example, computer-readable instructions stored in the memory 112. Execution of the computer-readable instructions can cause the forming device 100 to perform various functions, for example, the functionality of the forming device 100 described below, including all of the measurements and calculations needed to obtain an accurate K-factor. Although the control module 108 is illustrated as a separate entity, with respect to the hardware 102 and the software 104, it should be understood that the functions described with respect to the control module 108 can be performed by a combination of the hardware 102 and the software 104. For example, the hardware 102 can include a memory and a processor, and the software 104 can include the applications 116 and other data 118 illustrated in the memory 112. As such, it must be understood that the illustrated configuration is exemplary, and is described in the presented manner for ease of description.

The words "memory" and "storage device," as used herein collectively include, but are not limited to, processor registers, processor cache, random access memory (RAM), other volatile memory forms, and non-volatile, semi-permanent or permanent memory types; for example, tape-based media, optical media, flash media, hard disks, combinations thereof, and the like. While the memory 112 is illustrated as residing proximate the processor 110, it should be understood that the memory 112 can be a remotely accessed storage system, for example, a server and/or database on a communications network, a remote hard disk drive, a removable storage medium, a database, a server, an optical media writer, combinations thereof, and the like. Moreover, the memory 112 is intended to encompass network memory and/or other storage devices in wired or wireless communication with the forming device 100, which may utilize the network interface 106 to facilitate such communication. Thus, any of the data, applications, and/or software described below can be stored within the memory 112, the software 104, and/or accessed via network connections to other data processing systems (not shown) that may include a local area network (LAN), a metropolitan area network (MAN), a wide area network (WAN), and the like, for example.

The functionality of the control module 108 can be a combination of hardware and software. In some embodiments, hardware for executing the software can be located at a location remote from the control module 108. As such, while the control module 108 is described as a hardware device with associated software, it should be appreciated that the software and hardware devices can be remote from each other. In other words, the control module 108 is illustrated and described as a unitary device for ease and clarity of description, and not to limit the scope of the disclosure. In this description, the functionality of the control module 108 and the forming device 100 will at times be described as being performed by a CNC control. It should be understood that the CNC control, and the steps performed by the CNC control, are exemplary contemplated embodiments of the systems and methods of the present disclosure. As such, the CNC control should not be viewed as limiting the scope of this disclosure, or the scope of the appended claims.

Accordingly, concepts of the present disclosure may operate on the forming device 100, wherein the forming device 100 or the control module 108 is configured as a server to one or more client data processing systems as dictated by a client/server model. In some embodiments, for example, the control module 108 serves data to a web server such as, for example, a K-Factor database operating on the Internet.

The applications 116 can include various programs, routines, subroutines, algorithms, software, tools, and the like ("instructions"), for operating the forming device 100, calibrating various components of the forming device 100, bending applications for placing bends in a blank part, K-factor determination software for calculating a K-factor based upon various measurements and data tracked and input into the forming device 100, material and machine data export software, as well as programs or applications to make the forming device 100 operable to perform any of the functions, measurements, and calculations described below. The applications 116 can be executed by the processor 110 to make the forming device 100 operable to provide the desired function. The applications 116 also can include instructions for evaluating generated data, received data, and/or received data requests, and for sending data to one or more elements of a communications network. These and other functions of the control module 108 will be described in more detail below.

The applications 116 also can include instructions used to operate the forming device 100 and/or devices connected to the forming device 100, if any. The instructions can include, for example, operating systems, firmware, drivers for peripherals, and the like. The applications 116 also can include, for example, authentication software, billing applications, charging applications, monitoring applications, usage tracking applications, advertisements, reporting functions, and the like. As explained above, the applications can be included in the software 104, or the various software described with respect to the software 104 can be included in the applications 116 stored at the control module 108.

The other data 118 can include, for example, billing information, charging applications, account data, user device data such as a serial number, software, programs, algorithms, hardware data, network data, and the like.

Figure 2:
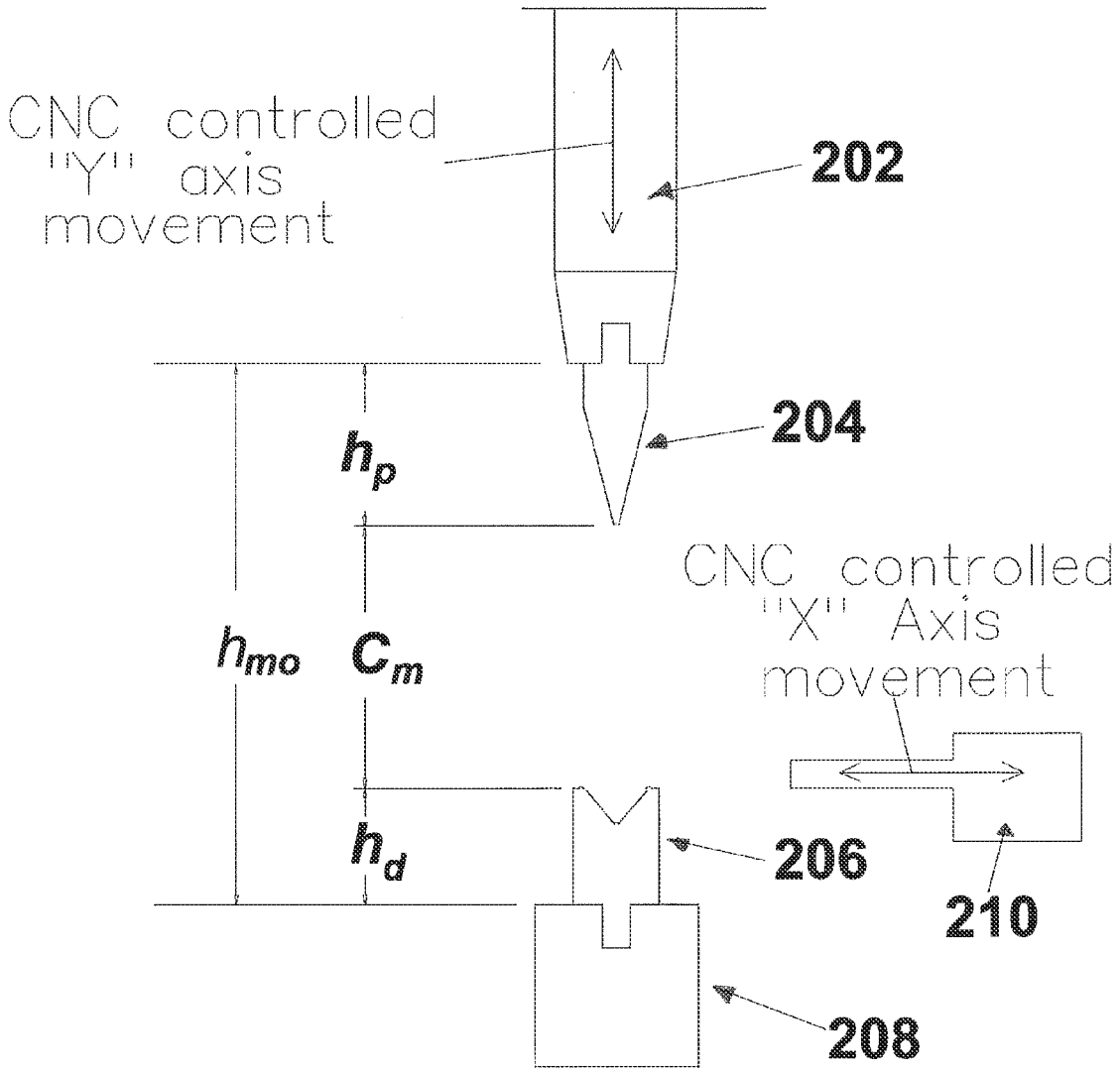
FIG. 2 illustrates a side view of the active components of a press brake, the ram (see, CNC Y axis), bed, forming tooling and material back gauge (see, CNC X axis), according to an exemplary embodiment of the present disclosure.

FIG. 2 Illustrates a side view of some of the active components of an exemplary forming device 100. While the systems and methods of the present disclosure can be employed on various devices, the exemplary active components of the forming device 100 will be described as the active components of a press brake. The forming device 100 can include a ram 202 for holding the upper forming tool 204. In some embodiments, the upper forming tool 204 includes a punch or other suitable forming device ("punch"). Though the upper forming tool 204 will be referred to herein as a punch, it should be understood other suitable forming tools may be used.

The ram 202 can be controlled by hardware and/or software associated with the forming device 100. The ram 202 can be advanced along a CNC-controlled Y Axis under pressure from a press mechanism to form material between the punch 204 and a lower forming tool or die 206 ("die"). As illustrated, the forming device 100 can include a bed 208 configured to support and hold the die 206. As will be explained in more detail below, the forming device 100 can track movement of the ram 202, for example the distance the ram 202 has traveled along the CNC-controlled Y Axis, and can use a value relating to the tracked movement to perform various calculations. These calculations will be described in detail below. In some embodiments, the movement of the ram 202 can be tracked in real time or near-real time, and the calculations disclosed below can be performed dynamically as the travel distance of the ram 202 changes.

The forming device 100 also can include a backgauge 210 for positioning the material being formed. As such, the backgauge 210 can be used to provide a CNC-controlled X axis along which to position the material being formed. By moving the material being formed, the forming device 100, or an operator or controller of the forming device 100, can adjust the position of the material to alter the position of features formed in the material being formed. For example, the backgauge 210 can be used to move a planned bend via the CNC control, or can be positioned manually by an operator using a manual gauge. As will be explained in more detail below, the forming device 100 can track movement of the backgauge 210, for example the distance the backgauge 210 has traveled along the CNC-controlled X Axis, and can use a value relating to the tracked movement to perform various calculations. These calculations will be described in detail below.

The die 206 can have a lower tool height $h_d$, i.e., the height of the die 206 from a reference point, e.g., the bed 208. In the illustrated example, the lower tool height $h_d$ is 2.165. It should be understood that this lower tool height $h_d$ is exemplary. Similarly, the punch 204 can have an upper tool height $h_p$, i.e., the height of the punch from a reference point, e.g., the end of the ram 202. As such, the upper tool height $h_p$ can include a height or length of the punch 204. In the illustrated example, the upper tool height $h_p$ is 3.000. It should be understood that this upper tool height $h_p$ is exemplary.

As illustrated in FIG. 2, there can be a machine clearance $c_m$ ("clearance") between the punch 204 and the die 206. The clearance $c_m$ can be determined with the punch 204 and the die 206 at full machine open height with the ram 202 at the top of the machine stroke. In the illustrated example, the forming device 100 has a machine open height $h_{mo}$ of 10.000. As such, the clearance $c_m$ of the forming device in the illustrated example can be calculated as ((the machine open height $h_{mo}$)−(the upper tool height $h_e$)−(the lower tool height $h_d$)). In the illustrated example, the clearance $c_m$ would be calculated as ((10.000)−(3.000)−(2.165))=4.835. It should be understood that this clearance will vary according to the tooling used as well as the length of the machine stroke. As such, this clearance $c_m$ is only exemplary.

In some embodiments of the present disclosure, all dimensional values of the machine and tooling, e.g., the lower tool height $h_d$, the upper tool height $h_p$, the clearance $c_m$, and the machine open height $h_{mo}$ can be known to the control module 108 of the forming device 100. The control module 108 can include for example, a CNC control of the forming device 100. Similarly, all dimensional values defining the punch 204 and the die 206 such as height, width, radius, V-opening shoulder or tip radius and angle, can be known to a CNC control of the forming device 100 and/or are otherwise accessible to a calibration utility associated with the forming device 100, for example, downloadable to the control module 108 from a website or database associated with the tooling manufacturer.

In operation, the forming device 100 can be used to form a piece of material into a part. During forming, the backgauge 210 can be moved to a position commanded by the CNC control, or manually positioned by the operator, to provide a back stop to position the bend on the part in the proper location for forming. The backgauge 210 can be a precision servo or other mechanically driven component, many of which are standard equipment on forming devices such as CNC press brakes.

Once the material is positioned in place by the backgauge 210, the forming device 100 can advance the ram 202 to a position in contact with the material. As mentioned above, the ram 202 is generally advanced along the CNC-controlled Y-axis, as illustrated in FIG. 2. As mentioned above, movement of the ram 202 can be tracked. The movement of the ram 202 can be tracked to any desired precision, from low precision to high precision. In some embodiments, the movement of the ram 202 is tracked with high precision. For example, movement of the ram 202 can be tracked in $1/10{,}000^{th}$'s of inches, $1/1{,}000^{th}$'s of inches (mils), micrometers (μm), millimeters (mm), or other desired units, depending upon how the controls of the forming device 100 are configured.

As the ram 202 advances along the Y-axis, the ram 202 contacts the material, i.e., the part to be formed, and the material can be trapped between the punch 204 and the die 206. As the ram 202 further advances under pressure from the driving system, the material being formed yields, and a bend is made in the material. As is known, the bend made can be a planar bend. As the ram 202 further advances, the bend can be further formed in the material. In general, a CNC program can define a depth to which the ram 202 should move, at which the angle of the bend formed in the material should be substantially equivalent to a desired angle. As is known, this depth can take the material springback into consideration when configuring the depth. When the desired angle is reached based on the upper tool or punch 204 having reached the depth instructed by the CNC control, the CNC control can command the ram 202 to return to a position allowing the formed part to be removed from the forming device 100.

Figure 3:
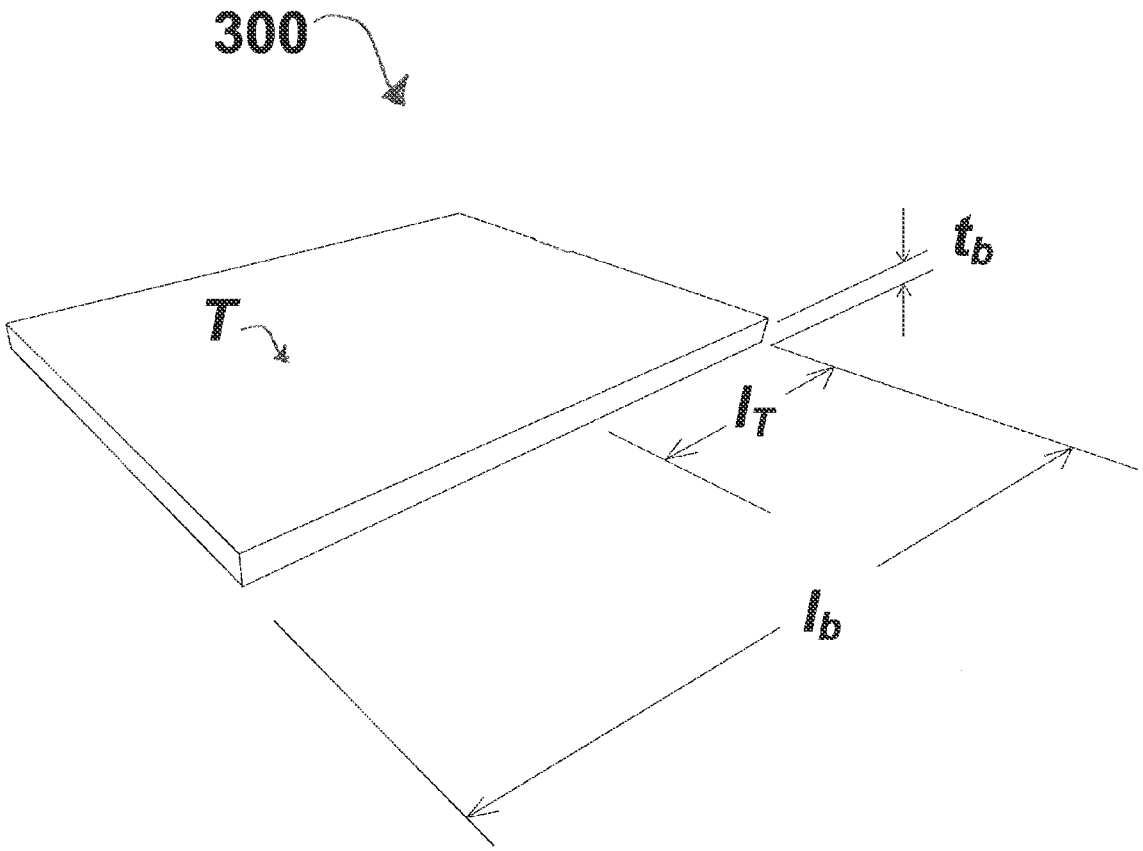
FIG. 3 Illustrates an isometric view of a flat calibration test sample material prior to forming, according to an exemplary embodiment of the present disclosure.

FIG. 3 illustrates an isometric view of an exemplary sample of material to be formed 300 ("blank") prior to being formed. The blank 300 can have any desired dimensions. In the illustrated example, the blank 300 has a material thickness $t_b$ of 0.179. It should be understood that this material thickness $t_b$ is exemplary. In the illustrated example, the blank 300 has a pre-formed flat length $l_b$ of 4.000. According to some exemplary embodiments of the present disclosure, the width of the blank or bend may not be relevant to the disclosed calibration process, and as such will not be detailed herein. As illustrated, a target length $l_T$ can define a length from a desired feature of the blank 300 to a target for a particular operation. It should be understood that the target length $l_T$ can be any desired dimension. In the illustrated embodiment, the target length $l_T$ is used to identify the targeted position of the bend target T, and is measured from the gauging edge of the blank 300. In the illustrated example, the target length $l_T$ is 2.000. It should be understood that this target length is exemplary.

While the position of the target Tin the blank 300 is generally not relevant to radius, neutral axis, or K-factor calculation, the target length $l_T$ can be about ½ of the pre-formed blank length $l_b$. Using this value, i.e., ½ of the pre-formed blank length $l_b$, can help allow the calibration of the CNC backgauge position to be verified. If the CNC backgauge position is found to be out of calibration, the backgauge position can be dynamically adjusted by the CNC control, as will be described later. In some embodiments, the measurements used to calibrate the CNC backgauge position can be input directly to the calibration utility from the measuring device using a direct data link to the CNC control.

Figure 4:
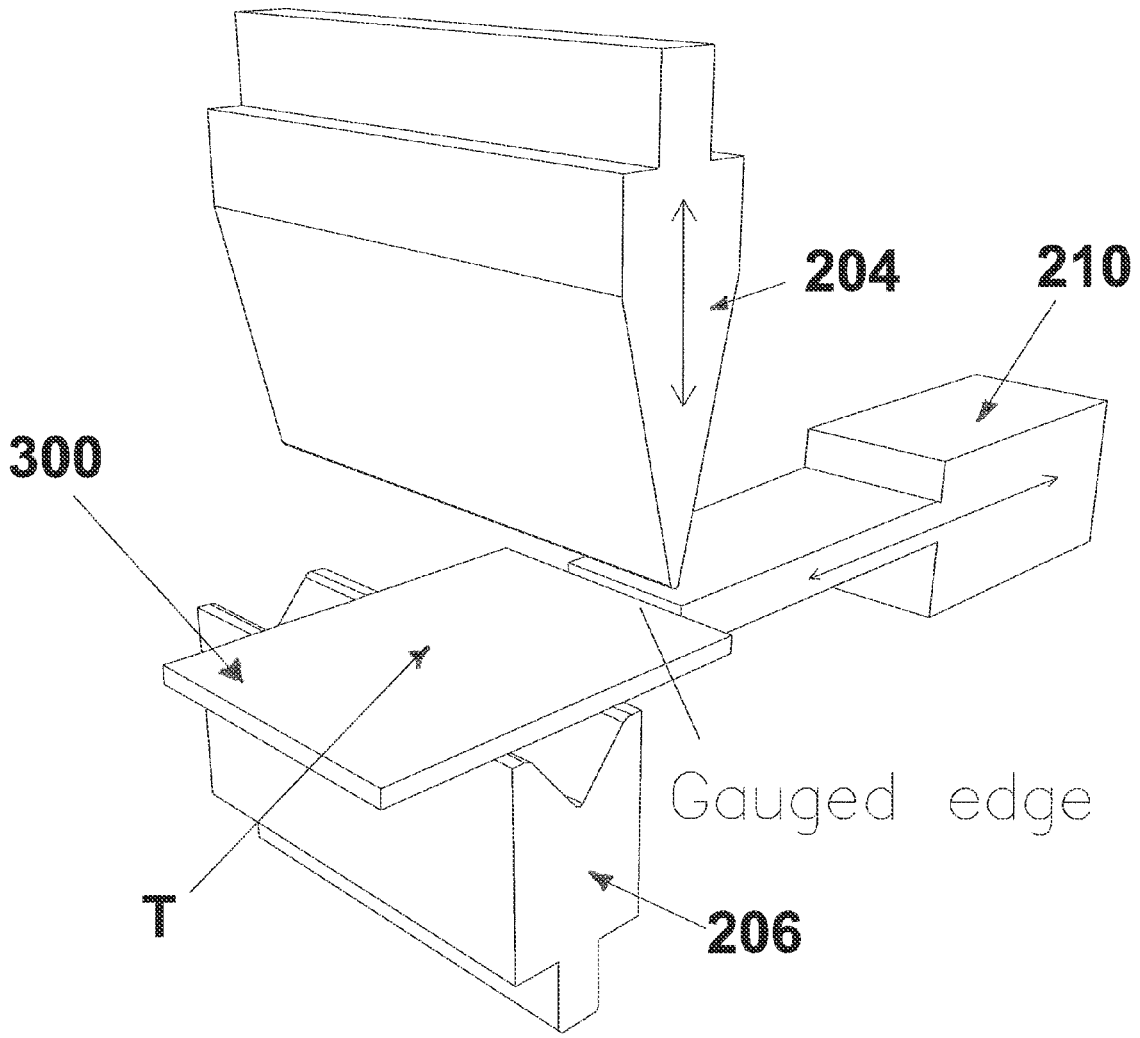
FIG. 4 Illustrates an isometric view of the backgauge aligning the bend position on the sample between the tooling prior to the bending process, according to an exemplary embodiment of the present disclosure.

FIG. 4 Illustrates an isometric view depicting the backgauge 210 in a position. In the illustrated position, the CNC control has instructed the backgauge 210 to locate the blank 300 with the bend plane target T properly aligned with the punch 204 and die 206 prior to advancing the ram 202 and punch 204 toward the blank 300 to form a desired part. If the operator wishes to verify backgauge calibration as part of the calibration test, the operator can note which side of the blank 300 is against the gauge 210. Calibration of the backgauge 210 will be described in more detail below.

Figure 5:
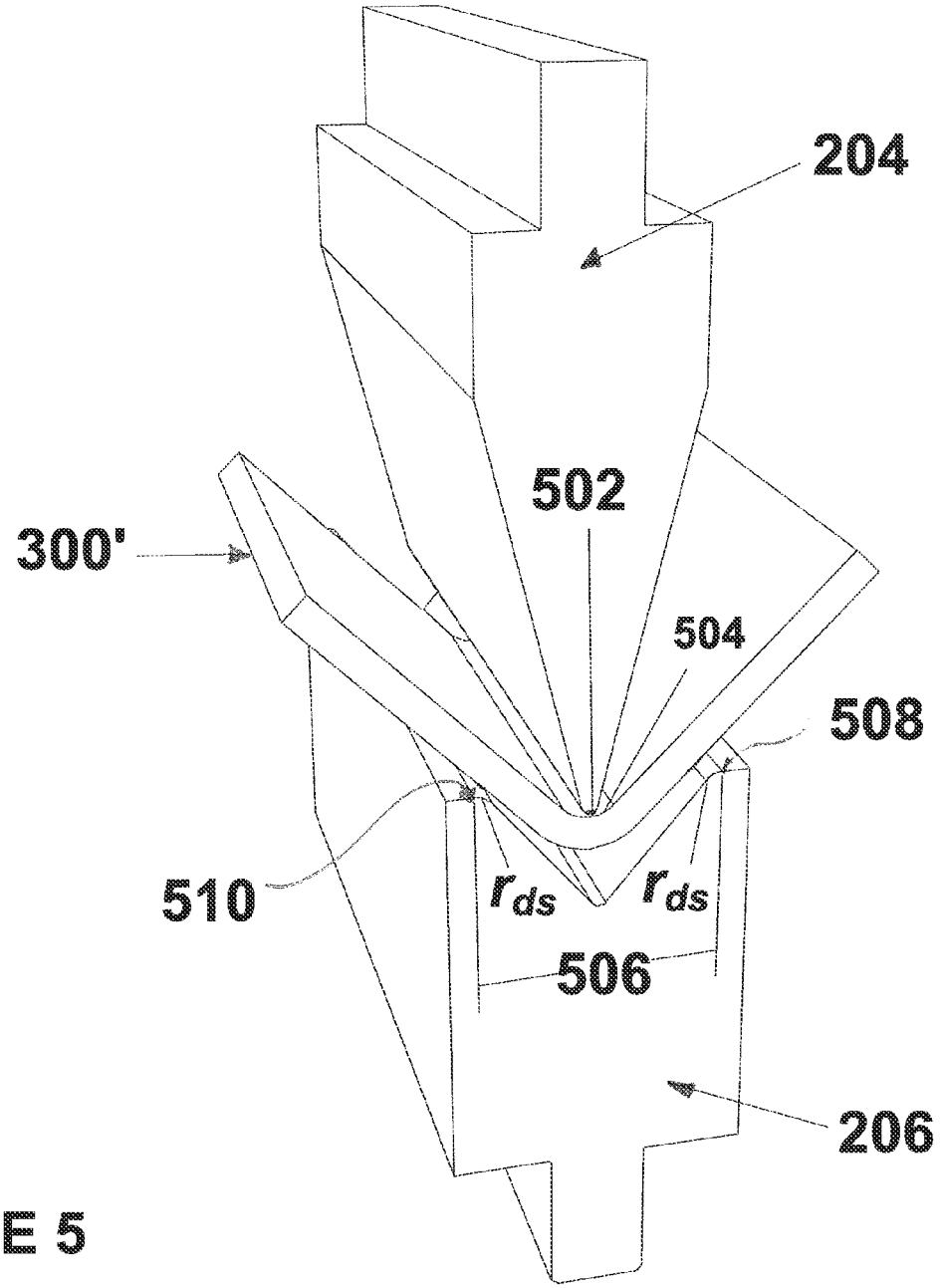
FIG. 5 Illustrates an isometric view depicting the tooling and sample material positions in a formed position, according to an exemplary embodiment of the present disclosure.

FIG. 5 Illustrates an isometric view of the punch 204, the die 206, and a part 300' in a forming position. It should be understood that the configuration illustrated in FIG. 5 is exemplary of a bending operation achieved by advancing the ram 202 and punch 204 toward the die 206, with the blank 300 (FIGS. 2-4) located therebetween. In the example illustrated in FIG. 5, the punch 204 has been advanced such that a bend of approximately 90° has been achieved. As such, the end of the punch 204 has reached the final tip position 502. Through this exemplary bending operation, a bend having an inside radius 504 has been created. It should be understood that the illustrated inside radius 504 is merely exemplary, and that the value of the inside radius 504 will vary depending upon many variables including, for example, the thickness of the material, the tooling used to achieve the bend, the pressure used to bend the material, the material hardness, the springback of the material, other variables, and combinations thereof. Also, it should be understood that the present invention provides systems and methods for accurately determining K-factor and bend allowance that are equally useful with bends that are greater or less than 90°, so the 90° bend shown in the exemplary embodiments was arbitrarily selected for purposes of teaching, and not of limitation.

Through the CNC systems control of the ram 202, the final tip position 502 of the punch 204 can be recorded by the utility from the CNC control. As will be explained below, the CNC systems control, or other hardware or software associated with the control module 108, can track movement of the ram 202 in extremely precise units, and use that movement to determine the final tip position 502. In other words, it should be clear that the final tip position 502 can be determined by recording the distance that the ram 202, and hence the punch 204, was advanced during a bending operation, for example, the above-described bending operation.

Various characteristics of the punch 204 and die 206 can be known to the control module 108, or to components thereof. For example, values for the length of the punch 204, the shoulder radii $r_{ds}$, the distance 506 between the points 508, 510 at which radii intersect with the top surface/plane of the die 206, and other data can be known by the CNC control. The distance 506 is referred to herein as the die plane intersect width, and will be discussed in more detail below. It should be understood that the die plane intersect width 506 is sometimes referred to as the "outside V-opening dimension."

Figures 6, 7:
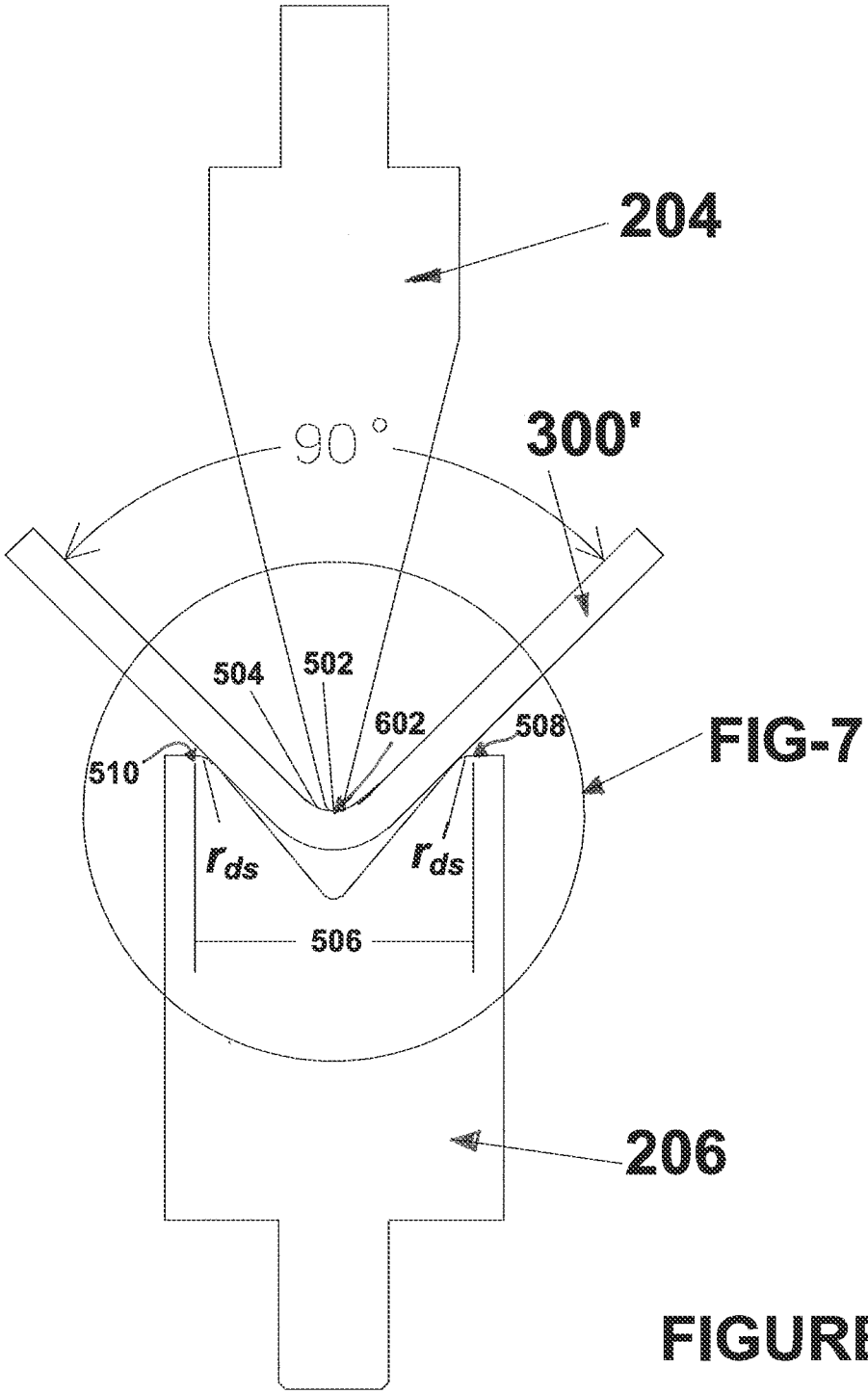
FIG. 6 Illustrates an end view of the tooling and sample material in the formed position, according to an exemplary embodiment of the present disclosure.
FIG. 7 Illustrates an enlarged end view of sample material, according to an exemplary embodiment of the present disclosure.
Figure 7:
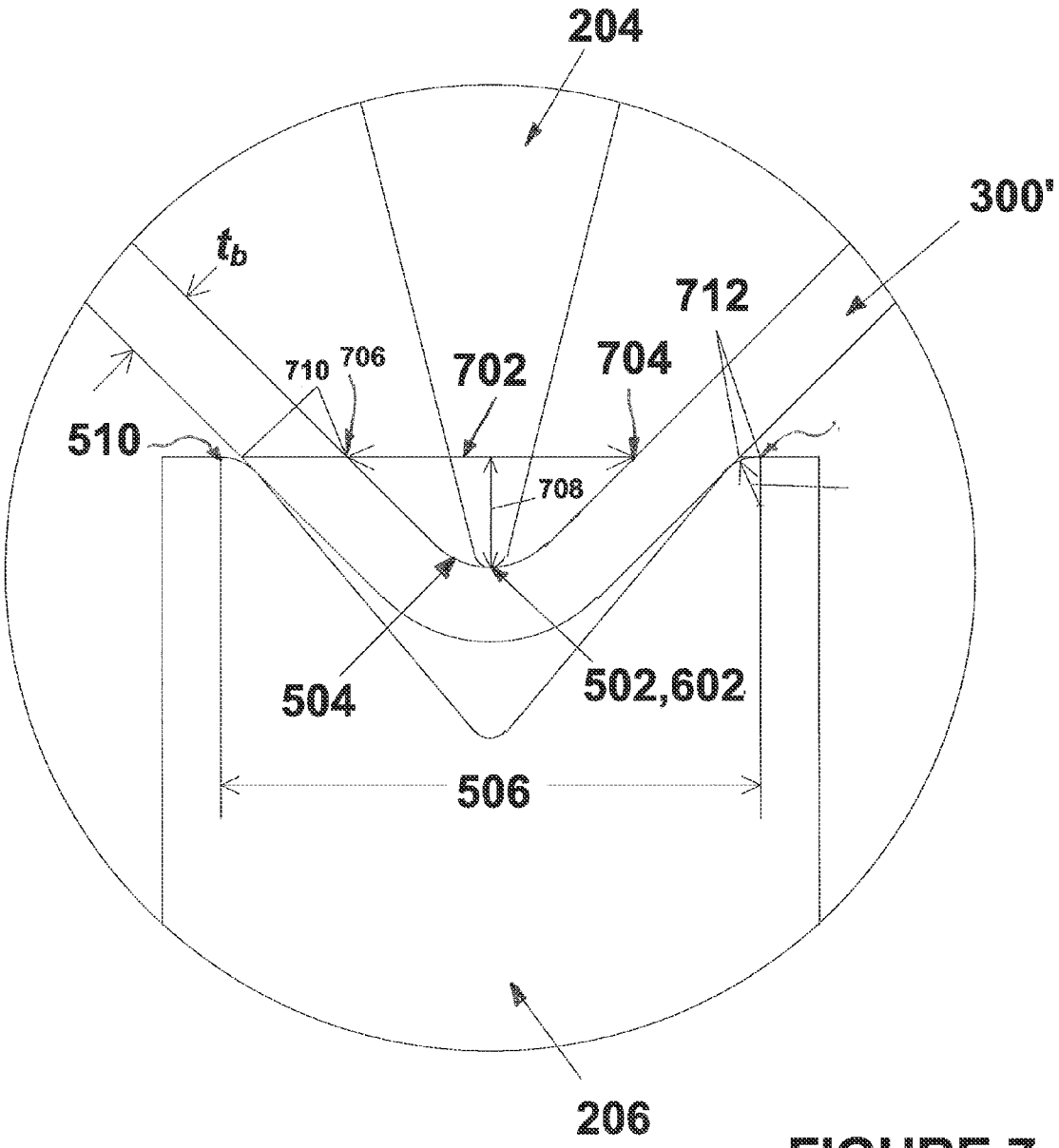

FIG. 6 illustrates an end view of the punch 204, the die 206, and the part 300' in the forming position, as illustrated in FIG. 5, to more clearly show details and provide a reference for the enlarged detail FIG. 7 view, the extents of which is denoted by the circle labeled FIG. 7. It should be noted that the punch tip 602 is at substantially the same location as the final tip position 502.

FIG. 7 shows in more detail various dimensional relationships of the tooling and the part 300'. FIG. 7 is intended to more clearly illustrate various details of the tooling and the part 300' to illustrate how a first set of calculation points can be used to measure the actual achieved inside bend radius 504. FIG. 7 is also intended to help illustrate how the determined inside bend radius 504 may be used to obtain an extremely accurate neutral axis length, radius, and K-factor for the material used for the blank 300, and hence the part 300'. The calculations performed to determine these values will be discussed below.

According to some embodiments of the present disclosure, the shoulder radii $r_{ds}$ of the die 206, the die plane intersect width 506 of the die 206, and the die height $h_d$ measured from the press bed 208, are all known to the CNC control, and can be stored in a memory device accessible by the CNC control. For the tooling used in the illustrated example, the die plane intersect width 506 is 1.2913, the shoulder radii $r_{ds}$ are 0.118, and the blank thickness $t_b$ is 0.179. It should be understood that these values for the die plane intersect width 506, the shoulder radii $r_{ds}$, and the blank thickness $t_b$, are all exemplary.

As mentioned briefly above, for purposes of this specification, the die plane intersect width 506 is used to refer to a distance between the points 508 and 510. The points 508 and 510 represent the locations, on opposite sides of the die 206, at which the planar top surface of the die 206 first begins to curve into the die 206. As illustrated, an imaginary line 702 can be drawn at the level of the planar top surface of the die 206. This line 702, if completed, would pass through the points 508 and 510, and will be used to refer to the level of the top surface of the die 206 ("die plane"). The illustrated die plane line 702 is stopped at the points 704, 706 at which the die plane line 702 contacts an inner surface of the part 300'. The specification will refer to the die plane, which should be understood as referring to the top surface of the die 206 and can be easily referenced by finding the die plane line 702. These points will be described in more detail below.

The punch tip penetration 708 represents the distance between the level of the punch tip 602 at the final tip position 502 and the level of the die plane 702, and will be discussed in more detail below. Similarly, the distance from outside material to inside material 710, i.e., the distance from the outside of the part 300' to the inside of the part 300' as measured at the level of the die plane 702, and the offset to outer surface intersect 712 ("shoulder offset"), i.e., the distance from the outside surface of the part 300' to the beginning of the shoulder at the point 508 will be discussed in more detail below.

According to some embodiments of the present disclosure, the inside radius 504 formed in the part 300' during the bending process can be calculated by determining the spatial relationships between the material of the part 300' and the tooling at an achieved bend angle. As mentioned above, the illustrated example illustrates an achieved bend angle of 90°. The calculations used to determine the inside radius 504 will be described in more detail below.

Figure 8:
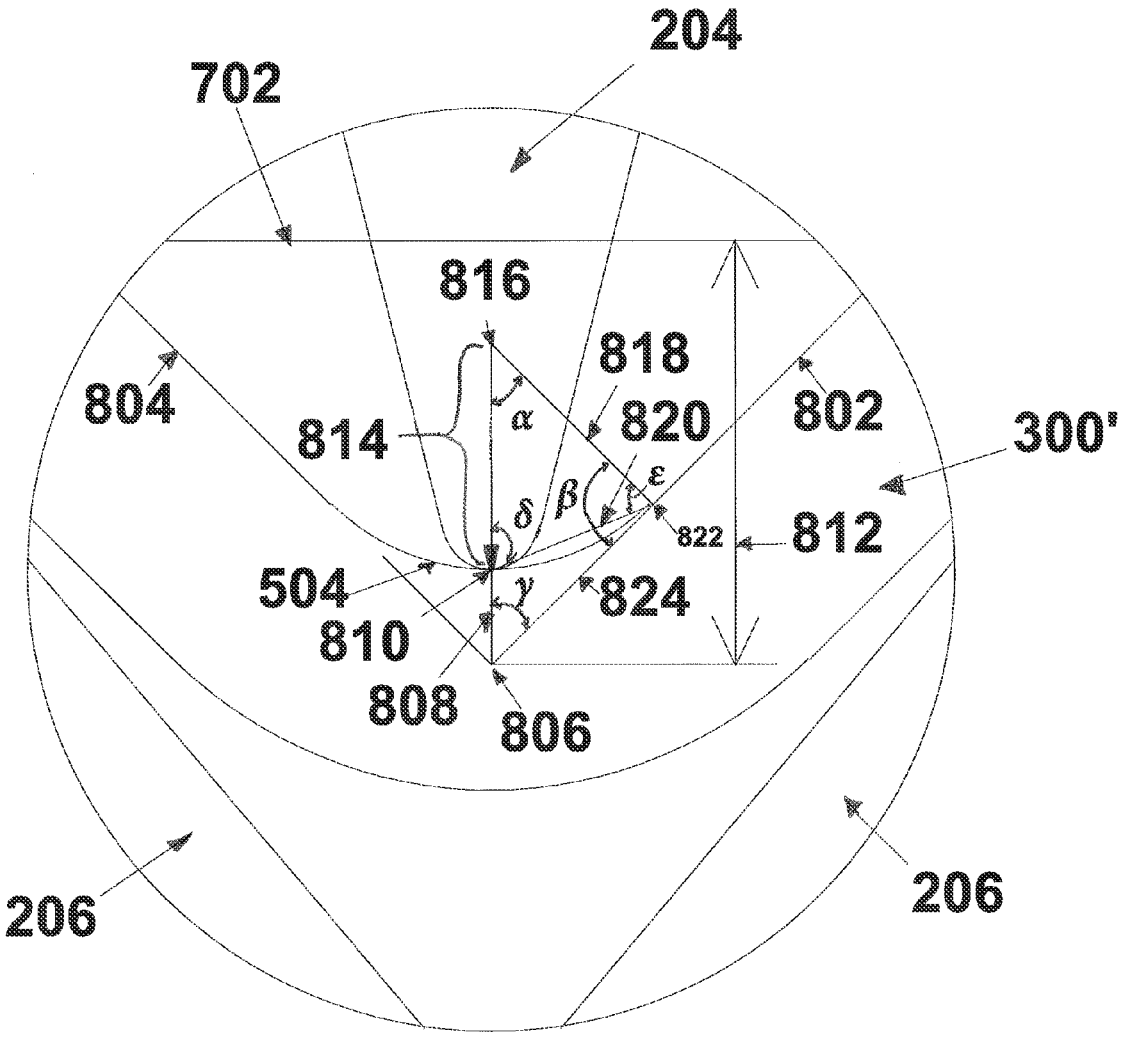
FIG. 8 Illustrates another enlarged end view of sample material, according to an exemplary embodiment of the present disclosure.

FIG. 8 shows another enlarged end view of a formed bend area of the part 300'. As will be explained below, exemplary embodiments of the present disclosure allow the balance of the radius measurement calculations to be defined based upon knowledge of the achieved inside bend radius 504, and various physical dimensions of the tooling, e.g., the punch 204 and the die 206, all of which will be described below.

As illustrated in FIG. 8, the part 300' includes two surfaces 802, 804. These surfaces 802, 804 are the surfaces of the part 300' facing the punch 204. In fact, portions of the surfaces 802, 804 contact the punch 204. For purposes of this specification, these surfaces 802, 804 will be referred to as the "inside surfaces." A theoretical inside intersect 806 can be calculated for the inside surfaces 802, 804. The theoretical inside intersect 806 represents a point at which the inside surfaces 802, 804 would intersect if these surfaces 802, 804 were projected along the part 300' without any bend in the part 300'. In such a theoretical part, there would be a corner formed at the theoretical inside intersect 806, as illustrated by the intersecting projection lines at the theoretical inside intersect 806.

As mentioned above, the travel of the ram 202, and therefore the final tip position 502 can be tracked, and therefore known, to the CNC control. As such, the punch penetration, i.e., the exact location 810 of the punch tip 602 at the punch tip depth 708, can be determined by using the known and determined values for the punch height $h_p$, the final tip position 502, and the clearance $c_m$. It should be understood that the point 810 also can denote the center of the inside bend radius 504.

The vertical distance 812 between the level of the die plane 702 and the level of the theoretical inside intersect 806 can be determined based upon the known tooling and the known movement of the punch 204, as explained above. FIG. 8 also illustrates the actual achieved inside bend radius 814, the value of which is equal to the length from the angle radius intersect corner 816 to the exact location 810 of the final tip position 502. The angle radius intersect corner 816 is the center point of the inside radius, and will be described in more detail below.

It should be understood that in some embodiments, forming tools may provide unusual inside radii, i.e., the calculated radius may be less than the punch tip radius. For example, a special punch or top forming tool such as a punch with a large tip radius may provide such results. In such cases, exemplary embodiments of the present disclosure include using a default value for the radius. In some embodiments, the default radius can be the punch tip radius.

As illustrated in FIG. 8, the tangent intersect line 818 also can be calculated. The tangent intersect line 818 is a line that extends from the angle radius intersect corner 816, i.e., the center point of the outside and inside surface radii, to the tangent intersect 822 of the inside radius and the inside surface. The tangent intersect line 818 will be described in more detail below. FIG. 8 also includes the point to tangent line 820, which is a line that extends between the center of the bend radius 810 and is the tangent intersect of the inside radius and inside surface 822 ("tangent intersect"). The point to tangent line 820 will be described in more detail below. FIG. 8 also includes the theoretical intersect to tangent line 824. The theoretical intersect to tangent line 824 extends from the theoretical inside intersect 806 to the tangent intersect 822 of the inside radius and the inside surface. The theoretical intersect to tangent line 824 will be described below in more detail.

Figure 9:
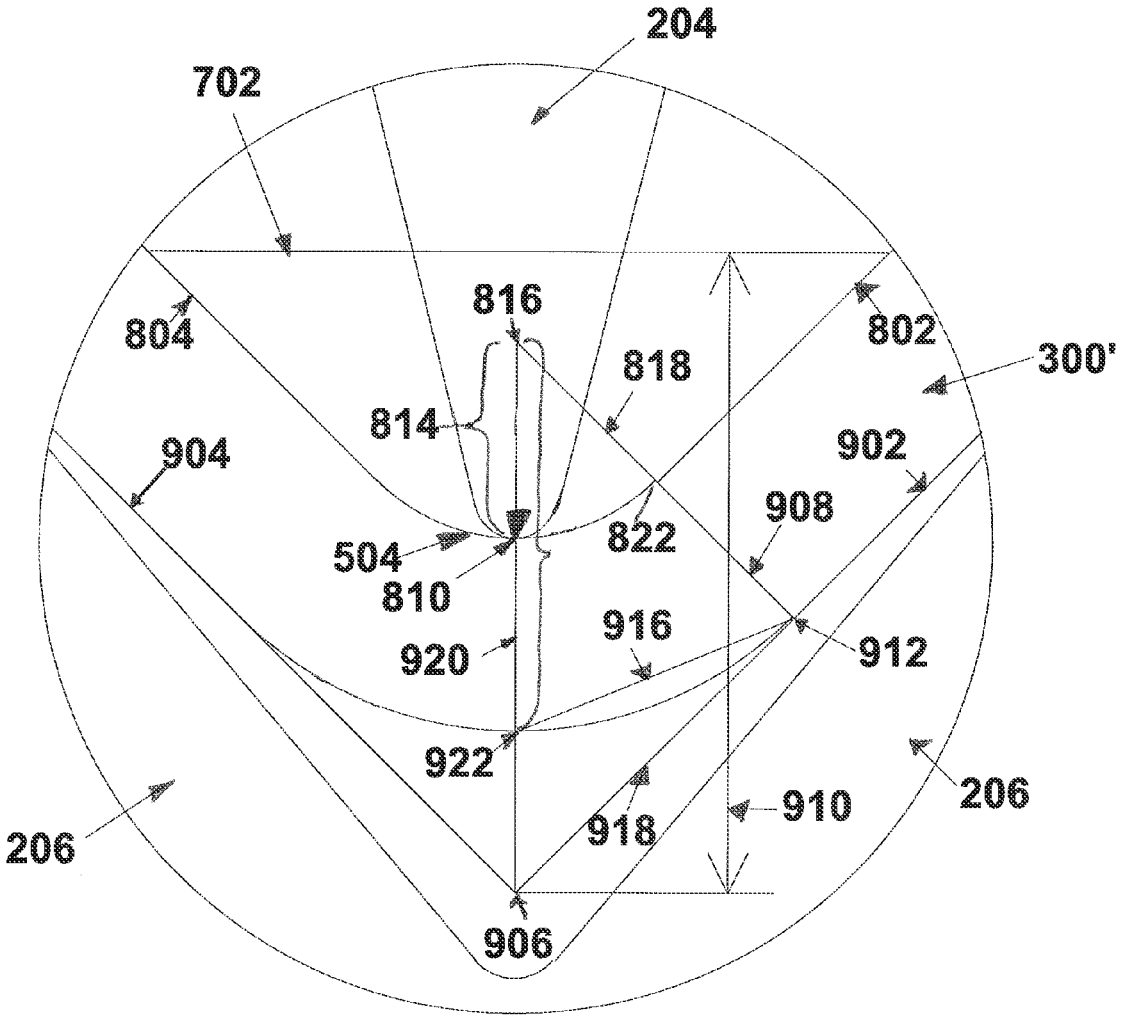
FIG. 9 Illustrates a further enlarged end view of the tooling and sample material in the formed position, according to another exemplary embodiment of the present disclosure.

FIG. 9 shows an additional embodiment of the present disclosure. In this embodiment, the various values of the formed part 300' and the sample material of the blank 300 can be calculated using various characteristics of the outside surface of the formed sample part 300' instead of, or in addition to, for example, the inside bend radius 504 of the part 300'. In general, the features relied upon, and the values and calculations based upon the features using an outside surface can be substantially similar to the features relied upon, and the values and calculations based upon the features using an inside surface. As such, these features, values, and calculations will not be described in detail for the sake of brevity. Similarly, the dimensions of the tooling and the part 300' illustrated in FIG. 9 will be described as being substantially identical to the tooling and the part 300' illustrated in FIGS. 5-8 for the sake of clarity, though the tooling can, as mentioned above, vary depending upon various factors.

The part 300' can include surfaces 902, 904. These surfaces 902, 904 are the surfaces of the part 300' that contact the inner surface of the die 206. For purposes of this specification, these surfaces 902, 904 will be referred to as the "outside surfaces." It will be appreciated that the outside surfaces 902, 904 are offset from the inside surfaces 802, 804 by the material thickness $t_b$. A theoretical outside intersect 906 can be calculated for the outside surfaces 902, 904. The theoretical outside intersect 906 can represent a point at which the outside surfaces 902, 904 would intersect if the outside surfaces 902, 904 of the part 300' were projected and could meet without any bend in the part 300'. In such a theoretical part, there would be a corner formed at the theoretical outside intersect 906, as illustrated by the intersect lines at the theoretical outside intersect 906.

The vertical distance 910 between the level of the die plane 702 and the level of the theoretical outside intersect 906 can be determined based upon the known tooling and the known movement of the punch 204, as explained above. Similarly, 814 is the actual achieved inside bend radius value of the formed part. In the case where a special punch/top forming tool is used, the calculated radius may be less than the punch tip radius. This can occur, for example, if a special punch with a large tip radius is used. In such cases, the radius value can be substituted with a default value. In some embodiments, the default value is the punch tip radius.

FIG. 9 also includes the tangent intersect 912 of the outside surface and the outside radius. The tangent intersect 912 of the outside surface and the outside radius is the point at which the formed outside surface bend radius 914 meets the outside surface of the formed part 300'. FIG. 9 also includes the intersect point to tangent line 916. The intersect point to tangent line 916 is a line that extends from the intersect point 922, the point at which the intersect line 920 and the outside surface bend radius 914 intersect, to the tangent intersect 912. The intersect point to tangent line 916 will be described in more detail below. FIG. 9 also includes the theoretical intersect to tangent line 918, a line that extends from the theoretical outside intersect 906 to the tangent intersect 912. The theoretical intersect to tangent line 918 will be described in more detail below.

Figure 10:
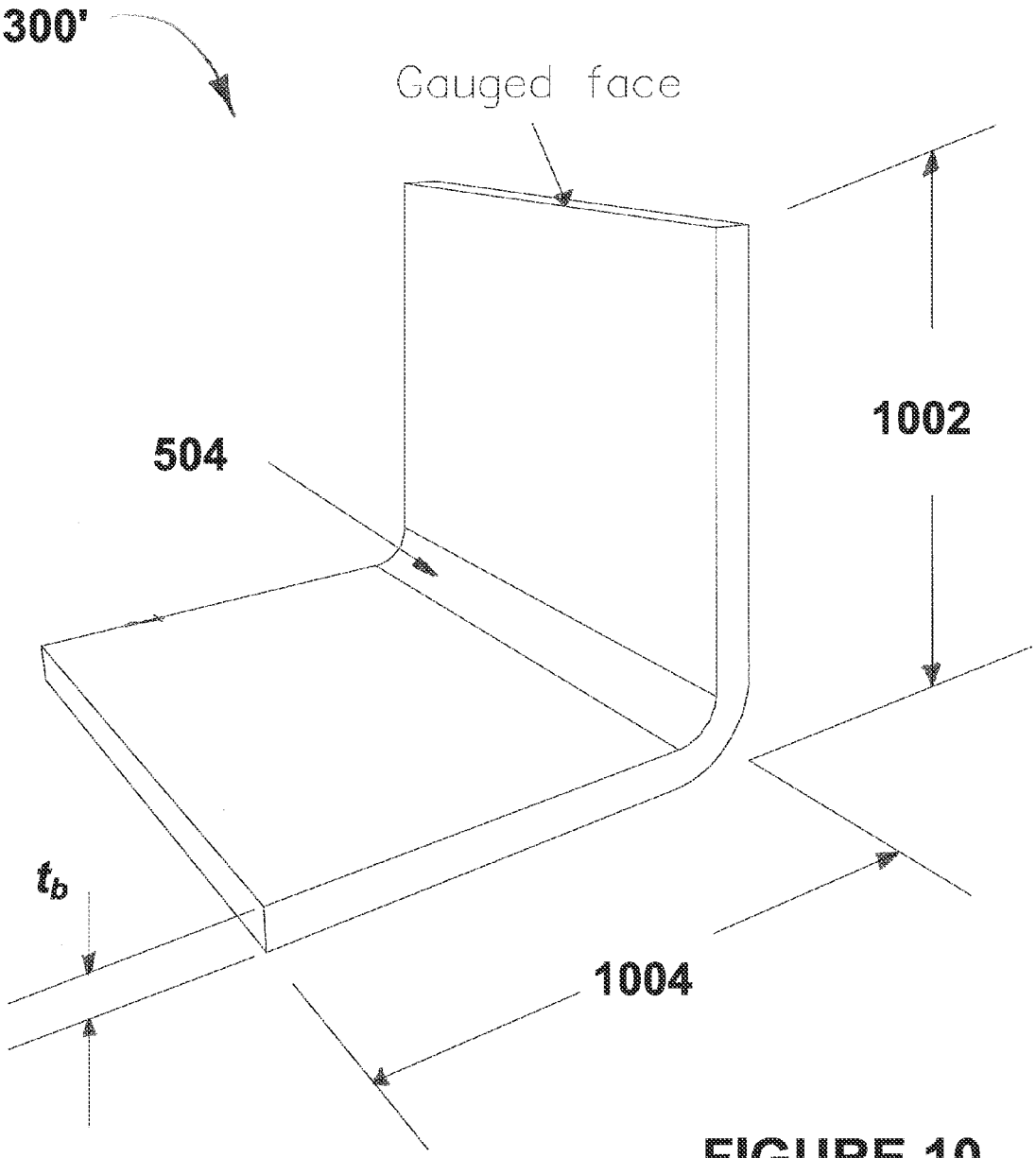
FIG. 10 illustrates a calibration sample after an exemplary forming process, according to an exemplary embodiment of the present disclosure.

FIG. 10 shows the formed sample part 300' with the operator-measured formed outside flange dimensions 1002 and 1004. The operator-measured outside flange dimensions 1002, 1004 will be discussed in more detail below.

Figure 11:
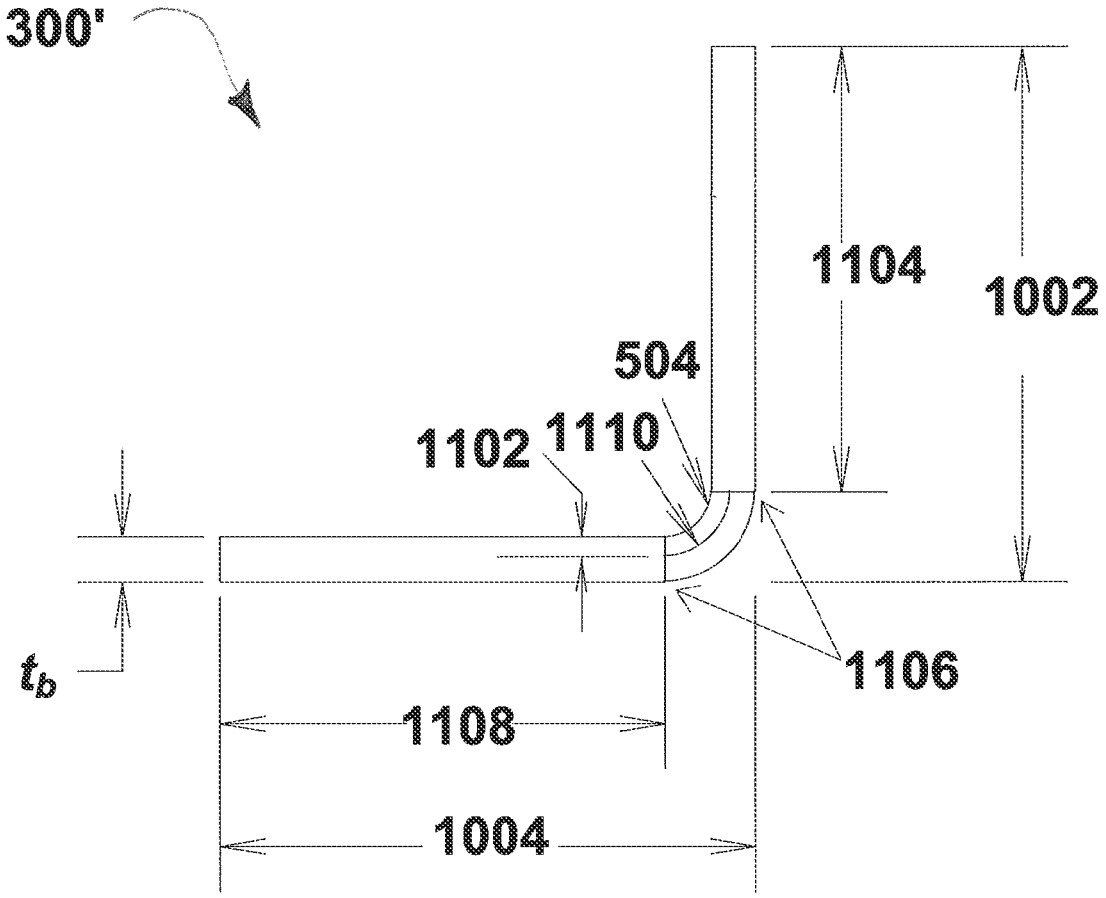
FIG. 11 illustrates the formed sample part and steps using measured inside or outside part radius to calculate the actual neutral axis length, radius and the resulting calibrated K-factor based on the material and tooling used to form the part, according to an exemplary embodiment of the present disclosure.

FIG. 11 shows the formed sample part 300', and defines several dimensions that will be used to calculate the K-factor 1102 for the material used to form the part 300'. The accurate determined K-factor 1102 can be used to calculate accurate values for the flat length of the gauge side flange 1104, the flat length of the operator side flange 1106, the neutral axis in the material 1108, the neutral axis radius, and the inside radius 504. These dimensions will be discussed in more detail below.

Figure 12:
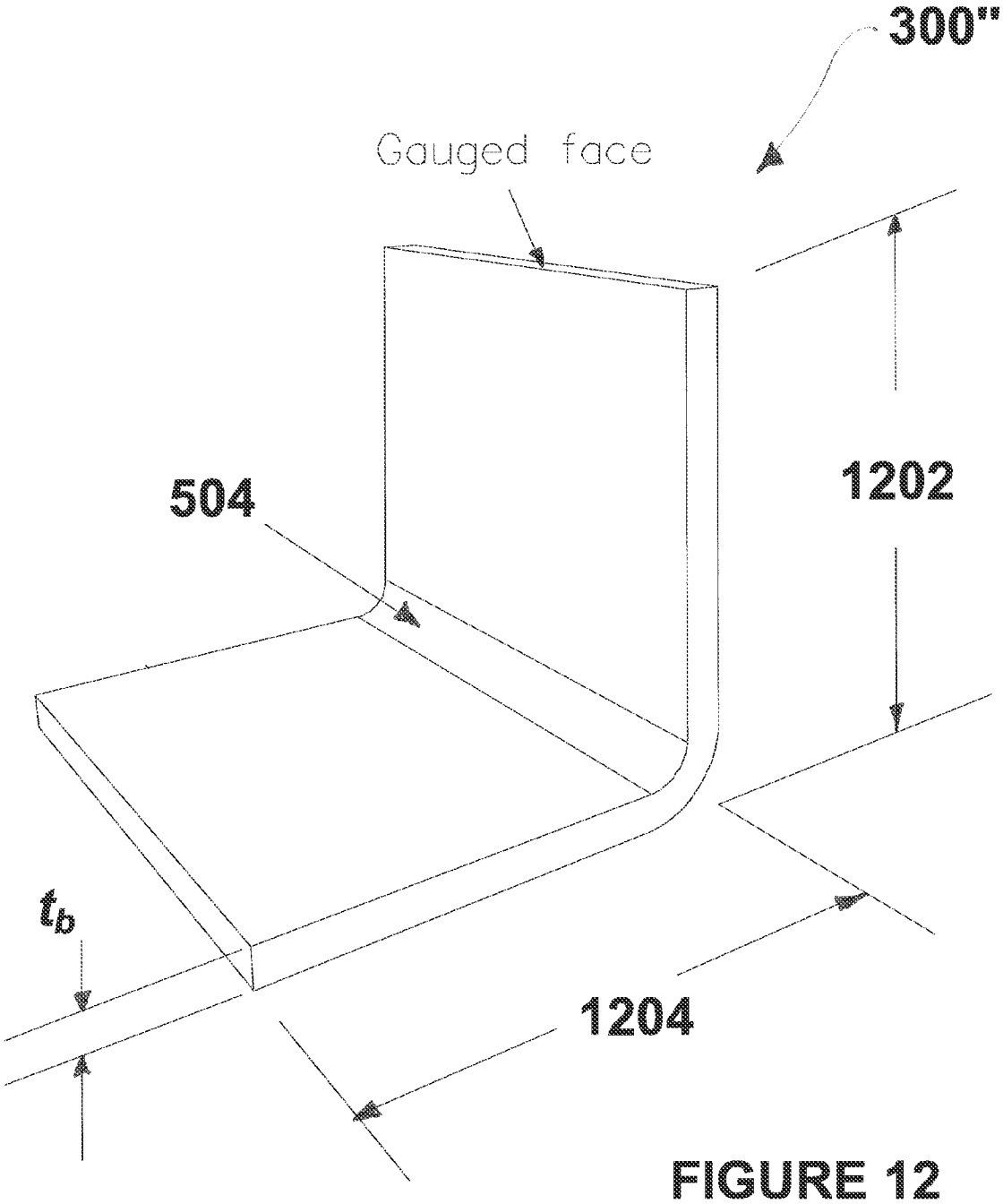
FIG. 12 illustrates an example of a calibration sample or part formed with the backgauge out of calibration/position, and demonstrates how this process can provide dynamic backgauge calibration and correction through adjusting the calibration value or by adjusting the bend position target to provide dynamic calibration and accurate gauge position, according to an exemplary embodiment of the present disclosure.

FIG. 12 shows another exemplary formed part 300". Several dimensions of the part 300" are shown, including the flat length of the gauge side flange 1202 and the flat length of the operator side flange 1204. In the illustrated example, the dimension 1202 has a value of 2.180, and the dimension 1204 has a value of 2.136. As will be explained below, the values of the dimensions 1202 and 1204 can indicate that the backgauge 210 is out of calibration. How it can be determined that the backgauge 210 is out of calibration based upon these values will be explained below. Furthermore, how the resulting values can be used to dynamically calibrate the position of the backgauge 210 also will be explained below.

Referring now to FIGS. 2-12, systems and methods according to the present disclosure allow various calculations to be completed to determine many physical characteristics of a formed part 300' by applying known, determined, and tracked data relating to the blank 300, the tooling, and movement of the tooling components relative to each other and to the blank 300. Some of these calculations will now be explained, and will reference various dimensions not previously addressed during the previous description of FIGS. 2-12. As mentioned above, all of the disclosed calculations and measurements can be performed by a control module 108 of a forming device 100, or by hardware 102 or software 104 associated with the forming device 100. All such embodiments are included in the scope of the disclosure and the appended claims.

Similarly, for the sake of brevity and clarity, the functions of the applications, routines, programs, software, hardware, and control modules will be described as being performed by a CNC control. An embodiment using a CNC control is merely exemplary, as other controllers are possible, and contemplated, and other devices and controls can implement principles of this disclosure including, but not limited to, the described functions.

As explained above, the die plane intersect width 506 is generally a known characteristic for a particular selected die or tooling package. For purposes of this example, the die plane intersect width 506 will be illustrated as having a value of 1.2913. As mentioned above, the die plane intersect width 506 is sometimes referred to as the "outside V-opening value," and this value can be known by or accessible to the CNC control.

As explained above, the punch tip position 502, i.e., the depth of the punch tip 602 with respect to the die plane level 702 can be determined by the CNC control by tracking movement of the tooling, for example, the ram 202, during movement. Of particular pertinence to this disclosure, the CNC control can determine the punch tip position 502 at the achieved bend angle by tracking movement of the tooling during the bending operation and applying the known tooling geometry to the tracked movement. For purposes of this example, the punch tip position 502 has a value of 0.2673. It should be understood that this punch tip position 502 is exemplary.

As mentioned above, various dimensions of the tooling can be known to the CNC control. For purposes of this example, the machine open height $h_{mo}$ of the exemplary tooling is assumed to have a value of 10.000. The punch 204 is assumed to have a height $h_p$ of 3.000. As such, the punch tip position relative to the ram 202 at the top of the machine stroke can be calculated as ((the machine open height $h_{mo}$)−(the punch height $h_e$)). As such, the punch tip position relative to the ram 202 at the top of the stroke for the illustrated example can be calculated as ((10.000)−(3.000))=7.000. It should be understood that this punch tip position relative to the ram 202 at the top of the stroke is merely exemplary.

During movement of the tooling, the CNC control can track the ram travel, i.e., the movement of the ram 202. In the illustrated example, the ram travel at the achieved bend angle of 90° is assumed to have a value of 5.1023. It should be understood that this ram travel value is exemplary.

The punch tip travel distance may be calculated by subtracting the ram travel from the punch tip position relative to the ram at the top of the stroke. In the illustrated example, the punch tip travel distance at the achieved bend angle of 90° may be calculated as ((7.000)−(5.1023))=1.8977. Again, the die height $h_d$, as well as other characteristics of the tooling can be known to CNC control. In the illustrated example, the die height $h_d$ is assumed to have a value of 2.165.

As such, the penetration 708 of the punch tip 602 below the top of the die 206 can be calculated as the die height $h_d$ minus the punch tip position 502 at the achieved bend angle. In the illustrated example, the punch tip penetration 708 may be calculated as ((2.165)−(1.8977))=0.2673. As would be expected, this punch tip penetration 708 is the same as the calculated punch tip position 502 calculated above. This is not necessarily the case, and it should be understood that this punch trip penetration 708 is exemplary.

A value for the shoulder offset 712, i.e., the offset from the outside of the V-opening to the shoulder radius intersect, can be calculated. More particularly, this offset 712 can represent the distance from the die plane 702, e.g., at one of the points 704, 706, and a point at which the part 300' contacts the inside surface of the die 206. The shoulder offset 712 is measured along the shoulder radius $r_{ds}$, and can be a known value for particular tooling. In the illustrated example, the shoulder offset 712 has a value of 0.0489 at the achieved bend angle of 90° in the plane of the top of the die 206. It should be understood that this shoulder offset 712 is exemplary.

At the 90° angle of the formed sample part 300', the angle between the shoulder radius $r_s$ and the die plane 702, i.e., the top surface of the die 206 and the outside of the formed sample part 300' surface intersect is a constant 22.5°. The shoulder offset 712 can be calculated as follows: ((the shoulder radius $r_{ds}$)*TAN(22.5)). In the illustrated example, the shoulder offset 712 has a value of ((0.118)*(0.4142136))=0.0489.

A value for the distance from outside material to inside material 710, i.e., the distance from the outside of the part 300' to the inside of the part 300' as measured at the level of the die plane 702 can be calculated. The distance from outside material to inside material 710 can be calculated as the square root of two times the material thickness $t_b$ squared, i.e., SQRT ($2*t_b^2$) or SQRT($t_b^2+t_b^2$). In the illustrated example, the distance from outside material to inside material 710 can be calculated as SQRT ($0.179^2+0.179^2$)=0.2531. It should be understood that this distance from outside material to inside material is exemplary.

A value for the inside-to-inside distance 702 between a point 704 at the inside surface of the part 300' to a point 706 at the other inside surface of the part 300' can be obtained. This inside-to-inside distance 702 is measured in the die plane 702 of the die 206, and can be calculated as ((the outside V-opening length 506)−(2*(the shoulder offset 712))−(2*(the distance from outside to inside material 710))). In the illustrated example, the inside-to-inside distance 702 can be calculated as ((1.291)−(0.0979)−(0.5063))=0.6871. It should be understood that this inside-to-inside distance 702 is exemplary.

As explained above, the theoretical inside intersect 806 is the point of theoretical intersect of the inside surfaces 802, 804 of the formed test part 300'. The inside surface and inside radius tangent intersect point 822 can be determined. The inside surface and inside radius tangent intersect point 822 is the tangent intersection of the formed inside surface bend radius 504 and an inside surface 802, 804 of the formed sample part 300'.

The angle radius intersect corner 816 can be calculated. The angle radius intersect corner 816 is the center point of the inside bend radius 504. Additionally, the angle radius intersect corner 816 is one of the corners of an isosceles right triangle formed between the intersect points 806, 816, and 822, and can be represented by the lines 808, 814, 818, and 824. The angle α between the lines 814 and 818 at the corner angle radius intersect corner 816 is equal to ½ of the sample part formed angle. In the illustrated example, the angle α between the lines 814 and 818 is 90° divided by 2, i.e., 90°/2=45°. It should be understood that this angle α is exemplary.

The depth 812 from the level of the die plane 702 of the die 206 to the level of the theoretical inside intersect 806 of the inside surfaces of the formed part 300' can be calculated. Based on the rule of right triangles, the depth 812 is equal to one-half of the inside-to-inside distance 702, i.e., the distance from one inside surface to the other inside surface of the formed part 300' along the die plane 702 of the die 206. In the illustrated example, the depth 812 is (0.5*0.6871)=0.3436. It should be understood that this depth 812 is exemplary.

The distance 808 between the theoretical inside intersect 806 and the punch tip penetration 708 can be calculated as ((the depth 812)−(the punch tip position 502)). In the illustrated example, the distance 808 is ((0.3436)−(0.2673))=0.0763. It should be understood that this distance 808 is exemplary.

The point 810 is the midpoint of the inside radius 504. Point 810 also is the point at which the punch tip 602 contacts the formed inside radius 504. It should be understood that the point 810 can be at substantially the same location as the punch tip position 502.

Construction of Triangles

To measure the formed inside radius 504, three triangles are constructed. A first isosceles right triangle is formed between the intersect points 806, 816, and 822, based on the formed angle of the sample part geometry and the rules of an isosceles right triangle. In the illustrated example, the angle β at 822=90° degrees, and angles α and γ, at points 806 and 816, respectively are 45°. In the illustrated example, the angles α and γ are calculated as follows: 180°−90°=90°/2=45°.

Two triangles are constructed inside the above defined right triangle by the line 820 constructed between points 810 and 822 bisecting the first isosceles right triangle formed at the points 806, 816, and 822. An isosceles triangle formed between 810, 816, and 822 represented by lines 814, 818, and 820 has the following angle values: A first angle α at point 816 has the previously established value of 45°, based on the rule of isosceles triangles. The angles δ and ϵ at points 810 and 822, respectively are calculated as ((180°−α)/2). In the illustrated example, the angles δ and ϵ are calculated as 67.5°, calculated as: ((180°−45°)/2)=(135°/2)=67.5°.

The final triangle is formed between points 806, 810, and 822, represented by lines 808, 824, and 820 and with corresponding angles for each being 806=45° (90°/2), 822=22.5 (90°−67.5°), and 810=112.5° (180−67.5°). The above-described geometry relationships and the corresponding angles are a constant regardless of the value of the inside radius that results from the forming process. The length of the lines 808, 820, 824, 818, and 814 will change based on the formed radius.

A line 820 can be constructed from the center 810 of the bend radius, i.e., the punch tip point, to the tangent intersect of the inside radius and the inside surface 822 of formed sample. The length of the line 820 can be calculated as follows: ((the length of the line 808)*((SIN(45))/(SIN(22.5))). In the illustrated example, the length of the line 820 can be calculated as ((0.0763)*((0.7071068)/(0.3826834)))=0.1410. It should be understood that this length is exemplary.

The measured inside radius 814 of the formed part 300' can be obtained. There are multiple methods for obtaining the measured inside radius 814. For the first method, the length 818/814 can be solved directly. The calculation for this method is ((the length of the line 820)*((SIN(67.5))/(SIN(45)))). For the illustrated example, this method gives the following calculation and final value: (((0.1410)*(0.9238795))/(0.7071068))=0.1842.

The second method is based on the rule of isosceles right triangles. In the second method, sides 824 and 818 are equal. As such, one can determine side 824 as follows: ((the distance 808)*((SIN(112.5))/(SIN(22.5))). In the illustrated example, this method gives the following calculation and final value: (((0.0763)*(0.9238795))/(0.3826834))=0.1842.

With the inside radius 814, the outside radius easily can be calculated. In the illustrated example, the outside radius can be calculated as ((the inside radius 814)+(the material thickness $t_b$). In the illustrated example, the outside radius can be calculated as ((0.1842)+(0.179))=0.3632.

In some cases, as mentioned above, a special punch/top forming tool may be used. In such cases, the calculated radius can be less than the punch tip radius. In such cases, for example, when a special punch with a large tip radius is used, the radius value can be substituted with a default value that is equal to the punch tip radius.

As mentioned above, an additional embodiment of the present disclosure entails using the outside radius of the formed part 300' instead of the inside radius 814. Some of the calculations needed for these calculations follow. In this additional exemplary embodiment, calculations for bend radius including inside radius using upper tool/punch position and outside surface and of the formed sample part. The following points, dimensions, and relationships easily can be seen in FIG. 9.

As mentioned above, the outside surfaces 902 and 904 are the outside surfaces of the formed sample part 300'. The sample blank outside surface intersection point 906 is the point of theoretical intersect of the outside surfaces 902 and 904 of the formed part 300'. The outside surface and outside radius tangent intersect point 912 is the tangent intersection of the formed outside surface bend radius 914 and the outside surfaces 902, 904 of the formed sample part 300'. The angle radius intersect corner 816 is the center point of the outside and inside surface radii as well as one of the corners of an isosceles right triangle formed between intersect points 906, 912, and 816, which can be traced by the lines 818, 814, 920, 918, and 908. The angle between the lines 814 and 818 at the corner 816 is equal to ½ of the formed angle of the sample part 300'. The formed angle of the sample part 300' is 90°. As such, the angle between the lines 814 and 818 at the corner 816 is (0.5*))(90°, or 45°. It should be understood that this angle is exemplary.

The distance 910 from the die plane 702 to the depth of the theoretical intersect 906 of the outside surfaces 902, 904 can be determined. The distance 910 can be calculated based on the rule of right triangles. The distance 910 is equal to ½ of distance between the top plane of the die 206 and the outside surface 902, 904 intersect of the formed sample part 300'. This distance 910 can be calculated as (((the die plane intersect width 506)−(2*the shoulder offset 712))*0.5). In the illustrated example, the distance 910 can be calculated as ((1.2913−(2*0.0489))*0.5)=0.5967. It should be understood that this distance 910 is exemplary.

The center of the inside radius intersect point 810 is the center point of the inside radius 504. Additionally, the inside radius intersect point 810 is also the point at which the punch tip 602 contacts the formed inside radius 504 and is also the point tip position 502. The punch tip position 502 is calculated above.

The length of a line 920 that extends between the outside theoretical intersect 906 and the punch tip penetration/inside radius mid point 810 also can be calculated. The length of this line 920 can be calculated as the distance 910 minus the punch tip penetration 708. In the illustrated example, the length of this line 920 can be calculated as ((0.5967)−(0.2673))=0.3294. It should be understood that this length of the line 920 is exemplary. The intersect point 922 is the point located at the intersect of the line 920 and the outside surface bend radius 914.

Construction of Triangles

To measure the inside radius, three triangles can be constructed. These three triangles can be used to determine the various dimensions needed to determine the inside radius.

A first isosceles right triangle can be formed between the intersect points 906, 912, and 816. Based on the formed angle of the sample part geometry and the rules of an isosceles right triangle, the angle between the lines 908 and 918 at the point 912=90° degrees. The angle between the lines 920 and 818 at the point 816, and the angle between the lines 918 and 920 at the point 906, respectively, can be calculated as ((180°−the angle between the lines 908 and 918 at the point 912)/2). In the illustrated example, the angles at 816 and 906 can be calculated as ((180°−90°)/2)=45°.

Two triangles are constructed within the first isosceles right triangle by the line 916 constructed between the points 922 and 912. The line 916 bisects the first isosceles right triangle.

An isosceles triangle formed between the points 922, 912, and 816 has the following angle values: The angle at the point 816 has the previously established value of 45°. Based on the rule of isosceles triangles, the angles at the points 922 and 912 can be calculated as ((180°−the angle at the point 816)/2). In the illustrated example, the angles at the points 922 and 912 can be calculated as ((180°−45°)/2)=67.5°.

The final triangle is formed between the points 906, 912, and 922. The final triangle can be represented by lines corresponding to angles for each of the points 906, 912, and 922. The angles at each of the three points can be calculated as follows: The angle at 906 can be calculated as (90°/2)=45°. The angle at 912 can be calculated as (90°−67.5°)=22.5°. The angle at 922 can be calculated as (180°−67.5°)=112.5°.

The above-described geometry relationships and the corresponding angles are a constant no matter the value of the inside radius that results from the forming process. The length of the lines 818, 814, 920, 916, 918, and 908 can change based on the formed radius and/or the material thickness of the formed part.

A line 916 can be constructed between the intersect point 922 and the tangent point 912. The length of the line 916 can be calculated as follows: First the length of the line between the theoretical outside intersect 906 and the point 922 is calculated. The length of the line between 906 and 922 is equal to the ((length of the line 920)−(the material thickness $t_b$)). In the illustrated example, the length of the line 916 is ((0.3294)−(0.179))=0.1504. The length calculation for the illustrated example can be calculated as ((0.1504)*(SIN(45))/(SIN(22.5))), or (((0.1504)*(0.7071068))/(0.3826834))=0.2779. It should be understood that this length is exemplary.

The length of the line 918 can be calculated based upon the rule of isosceles right triangles. In particular, the length of the line 918 and the combined length of the line 908, i.e., the line extending from the center point 816 to the tangent point 912, are equal. The length of the line 918 can therefore be determined as ((the distance from point 906 to the point 922)*((SIN(112.5))/(SIN(22.5))). In the illustrated example, the length of the line 918 can be calculated as (((0.2779)*(0.9238795))/(0.7071068))=0.3632. It should be understood that this length is exemplary.

The outside radius 914 can be calculated in the same manner as set forth above, namely, the inside radius 504 plus the material thickness $t_b$. Without repeating the calculation here, the outside radius 914 of the illustrated example is 0.3632. It should be understood that this outside radius 914 is exemplary.

The measured inside radius 504 of the part 300' can be calculated. As with the other embodiments described above, there are several ways to solve for the inside radius 504 based on the geometry constructed. In one embodiment, the inside radius can be determined using a solution based on the rule of isosceles triangles FIG. 8. In particular, the length of the line 818 and the length of the radius 814 are equal, represent the formed inside radius dimension. Therefore, one can calculate the length of the line 818 to determine the inside radius 504. The length of 814 is equal to the length of the line 918 minus the length of the line 908. The length of the line 908 is equal to the material thickness $t_b$. As such, the measured inside radius 504, which is equal to the length of the radius 814 can be calculated for the illustrated example as ((0.3632)−(0.179))=0.1842. It should be understood that this radius 504, 814 is exemplary.

In some cases, as mentioned above, a special punch/top forming tool may be used. In such cases, the calculated radius can be less than the punch tip radius. In such cases, for example, when a special punch with a large tip radius is used, the radius value can be substituted with a default value that is equal to the punch tip radius.

Referring now to FIG. 10, a formed calibration sample part 300' with the measured achieved inside radius 504 of 0.1842 is illustrated. The part 300' includes several noted dimensions, including the formed outside dimensions (OD), i.e., the gauged face sample flange 1002, which has a value of 2.158 in the illustrated example, and the operator side formed flange 1004, which has a value of 2.158 in the illustrated example. As such, the total finished OD for the part 300' of the illustrated example is (2.158+2.158)=4.316. It should be understood that this total finished OD is exemplary.

The equal values of these two formed flanges 1002, 1004 indicates that the backgauge 210 is perfectly calibrated. The measurement of the gauge side flange 1002 and operator side flange 1004 can be made in several ways, for example, by the user/operator employing any existing precision measurement device such as a caliper, an optical measuring device, a height gauge, a CMM or scanning measurement system, or can be automatically made by a properly equipped forming device 100.

Input of measurements can be made directly to the calibration utility from the measuring device using, for example, a direct data link to the PC control, a wireless connection, or other known connectivity devices and methods. In some embodiments, the measured OD values are entered into the calibration utility on the CNC control or other computer by the user/operator.

Any difference in the measured dimensions of the gauged side flange 1002 and the operator side flange 1004 of the formed part 300' can indicate that the backgauge 210 is not accurately calibrated to the center plane of the press brake and tooling, as will be described with reference to FIG. 12. If the measured dimensions of the gauged side flange 1002 and the operator side flange 1004 are not equal, the operator may wish to calibrate the backgauge 210, though it should be appreciated that an out-of-calibration backgauge 210 will have no effect on the calculation of the achieved radius or any of the bend profile data such as neutral axis or K-factor as the total outside dimension as the total OD value, i.e., the sum of the dimensions 1002 and 1004, will remain the same.

FIG. 11 shows the formed part 300' and illustrates some of the values that may be obtained using systems and methods according to the present disclosure, including the K-factor 1102. As illustrated, the actual measured inside radius 504 can be obtained. In the illustrated example, the value of the inside radius 504 is 0.1842. The gauged side flange 1002 and the operator side flange 1004 are illustrated, both of which have the value of 2.158 in the illustrated example, which gives a total OD value of (2.158+2.158)=4.316, as discussed above.

The flat length of the gauged side flange 1104 also can be determined. The flat length of the gauged side flange is measured from the edge of the sample part 300' to the mold line or radius tangent intersect 1106. The flat length of the operator side flange 1108 from the edge of the part 300' to the mold line or radius tangent intersect 1106. The neutral axis 1110 is illustrated as well. The neutral axis in the material, including the length of the neutral axis through the bend, as well as the radius of the neural axis can be calculated. Finally, the K-factor 1102 is illustrated, and can be calculated.

The flat length of the gauged side flange 1104 also can be calculated. The flat length of the gauged side flange 1104 can be measured from the gauged edge of the sample part 300' to the mold line or radius tangent intersect 1106. The flat length of the gauged side flange 1104 can be calculated as ((the length of the gauged side flange 1002)−(the inside radius 814−the material thickness $t_b$)). In the illustrated example, the flat length of the gauged side flange 1104 can be calculated as ((2.158−(0.1842−0.179))=1.7948. It should be understood that this flat length of the gauged side flange 1104 is exemplary.

The flat length of the operator side flange 1108 also can be calculated. The flat length of the operator side flange 1108 can be measured from the operator the edge of the part 300' to the mold line or radius tangent intersect 1106. The flat length of the of the operator side flange 1108 can be calculated as ((the length of the operator side flange 1004)−(the inside radius 814−the material thickness $t_b$)). In the illustrated example, the flat length of the operator side flange 1108 can be calculated as ((2.158−(0.1842−0.179))=1.7948. It should be understood that this flat length of the operator side flange 1108 is exemplary.

These calculations may also be made using the outside radius 914. The flat length of the gauged side flange 1104 can be calculated as ((the length of the gauged side flange 1002)−(the outside radius 914)). In the illustrated example, the flat length of the gauged side flange 1104 can be calculated as ((2.158)−(0.3632))=1.7948. It should be understood that this flat length of the gauged side flange 1104 is exemplary.

The flat length of the of the operator side flange 1108 can be calculated as ((the length of the gauged side flange 1002)−(the outside radius 914)). In the illustrated example, the flat length of the operator side flange 1108 can be calculated as ((2.158)−(0.3632))=1.7948. It should be understood that this flat length of the operator side flange 1108 is exemplary.

The length of the neutral axis 1110 along the neutral axis radius, from the first mold line/radius intersect 1106 to the second mold line/radius intersect 1106 through the bend can be calculated. The measured neutral axis length can be calculated as (((the gauge side flange 1002)+(the operator side flange 1004))−((the flat length of the gauge side flange 1108)+(the flat length of the operator side flange 1104))). In the illustrated example, the neutral axis length along the neutral axis radius can be calculated as ((4.316)−(3.5896))=0.4104. It should be understood that this neutral axis length is exemplary.

The neutral axis radius also can be calculated as follows. The neutral axis length is equal to 90°s of bend/arc length, or 25% of the circumference. As such, the measured neutral axis radius can be calculated as ((the length of the neutral axis 1110)*(4/pi/2)). In the illustrated example, the measured neutral axis radius can be calculated as ((0.4104)*(4/3.14159265/2))=0.2162. It should be understood that this neutral axis radius is exemplary.

The K-factor 1102 also can be calculated. The K-factor is a value that represents the depth of the neutral axis from the inside surface of the part 300'. The measured calibrated K-factor can be calculated as (((the radius of the neutral axis 1110)−(the measured inside radius 504))/(the material thickness $t_b$)). In the illustrated example, the measured calibrated K-factor 1102 can be calculated as (((0.2612)−(0.1842))/(0.179))=0.4306. It should be understood that this K-factor 1102 is exemplary.

Export of the Measured Values

As mentioned above, the measured value for each of the tracked, measured, calculated, and determined parameters can be stored by the utility, or by an export or storage utility, at a storage location, for example, in a database, a memory device, a network storage device, or another storage location. The storage location can be located at the control, or can be made accessible through a computer network. For the illustrated example, the measured values can be, for example, 0.1842 for the inside radius 814, 0.3623 for the outside radius 914, 0.4104 for the length of the neutral axis 1110, 0.2612 for the neutral axis radius, and 0.4306 for the K-factor value 1102. As explained above, these values can be exported to a storage location, if desired, and can be accessible by forming devices or other devices.

For example, the measured and calibrated neutral axis length (also known as the bend allowance) can now be used together with the measured and calibrated inside radius value by the press brake control software to produce full accurate flat pattern layouts and the corresponding backgauge position calculations. It can also be used when exported to or remotely accessed by external CAM, offline programming, 2D and 3D, 3D unfolding and 3D design systems that employ.

The measured and calibrated K-factor also can be used with the measured and calibrated inside radius value by the press brake control software to produce full accurate flat pattern layouts and corresponding backgauge position calculations. The measured and calibrated K-factor also can be used when exported to, or remotely accessed by external CAM, offline programming, 2D, 3D, 3D unfolding, 3D design systems, and other systems that can be configured to use the K-factors.

Calibration

FIG. 12 illustrates a sample part 300" as formed. The example of FIG. 12 is included to demonstrate an example of measured and/or determined dimensions that may be obtained if the backgauge 210 is out of calibration. Additionally, the example of FIG. 12 is used to demonstrate how the data from the illustrated processes can be used to dynamically calibrate the backgauge 210.

In this example, the blank used to form the part 300" is assumed to have had the same 4.000 length as the blank 300. During forming of the part 300", the backgauge 210 was set at the same ½ flat length value or 2.000 and the part 300" was formed. The resulting measurement of the gauge side flange 1202 of the part 300" is 2.180, and the resulting measurement of the operator side flange 1204 of the part 300" is 2.136. It should be understood that these values are exemplary, and that any uneven measurements could indicate that the backgauge 210 is out of calibration.

Given the dimensions of 1202 and 1204, the formed cumulative OD value of the part 300" can be calculated as ((2.180)+(2.136))=4.316, which is identical to the total OD value obtained for the part 300'. The difference between the parts 300' and 300" is that the bend made in the part 300" is not centered on the formed part 300", while the bend made in the part 300' is centered on the part 300'. This condition, i.e., that the bend is not centered on a formed part, is caused when the backgauge 210 is out of calibration and does not position the blank properly for the bending.

According to some embodiments of the present disclosure, the calibration utility can use the obtained dimensions 1202 and 1204 to calculate the total error for the bending process. The total error can be calculated as ((the gauge side OD length 1202)−((the OD total)/2)). In the illustrated example, the total error can be calculated as ((2.180)−(2.158))=0.022 flange length error.

This total error value indicates that the backgauge 210 positioned the blank material 0.011 further from the bend position than was called for by the CNC control. According to embodiments of the present disclosure, the calibration point or backgauge target value can be dynamically adjusted using a correction value generated by this process and utility to calibrate the backgauge 210. In the illustrated example, the utility can adjust the backgauge 210 to move the blank material 0.011 closer to the bend plane. Calibrating the backgauge 210 also can be done manually, as well as automatically. In some additional embodiments, the backgauge 210 is calibrated by altering or editing the parameters of the CNC control, or by mechanically adjusting the gauge finger to eliminate the error. In some embodiments, the gauge targets are simply adjusted by the determined error, or the backgauge 210 can be adjusted by a determined error. All such calibration techniques are contemplated, and are included in the scope of the appended claims.

This function also can be used during production forming on any material that has a calibrated neutral axis 1110 and K-factor 1102 recorded in the control, or other storage location, as any error in the flat layout has been eliminated allowing the process to provide exact flange lengths. Whether conducting a backgauge calibration during a material calibration procedure or during production forming, input of measurements can be made directly to the calibration utility from the measuring device using a direct data link to the control, a wireless link, manual entry of the data, other devices and methods, or combinations thereof.

Figure 13:
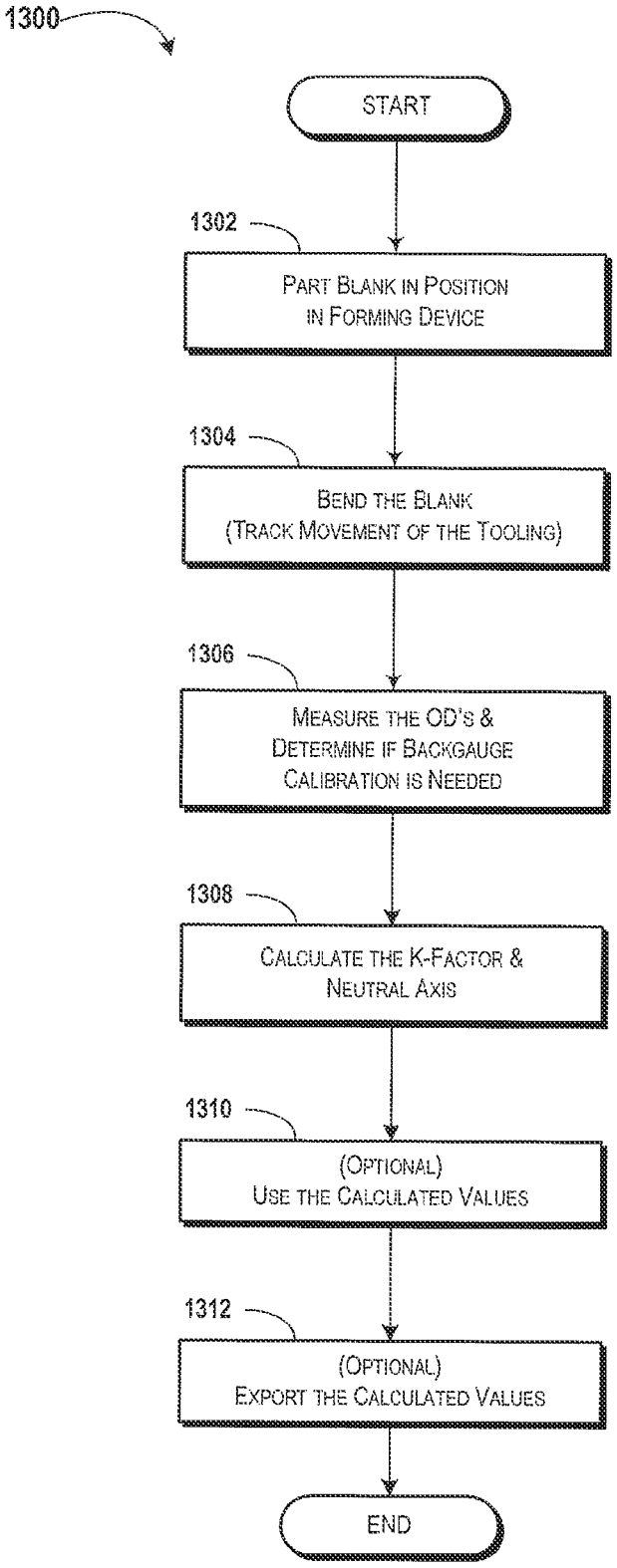
FIG. 13 schematically illustrates a method for determining, calibrating, and exporting a K-factor for a material sample using a determined inside bend radius, according to an exemplary embodiment of the present disclosure.

FIG. 13 schematically illustrates a method 1300 for determining, calibrating, and exporting a K-factor for a material sample using a determined inside bend radius 504, according to an exemplary embodiment of the present disclosure. During explanation of the method 1300, the specification will refer to the forming device 100 and exemplary parts and tooling such as those described in FIGS. 1-12. It should be understood that the forming devices 100, parts, and tooling referred to are merely exemplary, and are used solely for the purpose of clarifying principles of the disclosed systems and method. It also should be understood that the steps of the method 1300 are not necessarily presented in any particular order and that performance of some or all the steps in an alternative order(s) is possible and is contemplated. The steps have been presented in the demonstrated order for ease of description and illustration. Steps can be added, omitted and/or performed simultaneously, without departing from the scope of the appended claims. It should also be understood that the illustrated method 1300 can be ended at any time.

Some or all steps of the method 1300, and/or substantially equivalent steps, can be performed by execution of computer-readable instructions included on a computer-readable medium, e.g., the memory 112 of the control module 108, or another storage medium associated with or located at the forming device 100. The term "computer-readable medium" and variants thereof, as used in the description and claims, can include volatile and/or non-volatile, removable and/or non-removable media such as, for example, RAM, ROM, EEPROM, flash memory or other memory technology, CD ROM, DVD, or other optical disk storage, magnetic tape, magnetic disk storage or other magnetic storage devices, or other media that can be used to store the computer-readable instructions.

The method 1300 begins, and flow proceeds to block 1302, wherein a part blank such as, for example, the blank 300 is placed in a forming device 100. Although not illustrated in the method 1300, it should be appreciated that a desired part may be prototyped prior to placing the blank 300 in the forming device 100, and that the method 1300 can be used to calibrate the forming device 100. Additionally, it should be appreciated that the blank 300 can be dimensioned based upon various considerations including, for example, the anticipated layout of a planned part such as, for example, the parts 300' or 300".

At block 1304, the blank 300 is bent to form a part. During bending, the control of the forming device 100 can track movement of the tooling. As explained above, the forming device 100 can track movement of the ram 202, or other tooling in precise units. In some embodiments, movement of the ram 202 is tracked and is accurate to within $1/10{,}000^{th}$ of an inch. In other embodiments, the movement of the ram 202 is accurate to within $2/10{,}000^{th}$'s of an inch. It should be understood that the accuracy of the calculated values can increase as the accuracy of the tracked movement of the ram 202 increases.

At block 1306, the part can be measured to determine the OD's, for example, the gauged side flange 1002, the operator side flange 1004, the material thickness $t_b$, if not already known, as well as other characteristics of the parts. As explained above, if the length of the gauged side flange 1002 and the length of the operator side flange 1004 are not equal, it may indicate that the backgauge 210 needs to be calibrated. As such, the operator or control may determine at block 1306 whether the forming device 100 or a component thereof should be calibrated. For example, the operator or control may determine that the backgauge 210 should be calibrated. A method for calibrating the forming device 100 or a component thereof will be described below with reference to FIG. 14. For purposes of this method 1300, it will be assumed that the forming device 100 does not need to be calibrated.

At block 1308, values for various features of the part can be calculated based upon the value for the tracked movement as well as the obtained OD values. The calculation of these values includes calculation of any or all of the values described herein, and can include all of the calculations needed to determine the material's K-factor and neutral axis length and radius. These calculations will not be restated here. Instead, the reader is directed to the description of the calculated values described with reference to FIGS. 5-12, all of which can be calculated by using the tracked movement of the ram 202, the known characteristics of the tooling, and the measured OD's of the produced part.

At optional block 1310, the calculated values are used by the forming device 100 to alter, edit, or plan part design or CNC control code. The determined values may be used to correct errors in a formed part or part program, or to plan a new part or part prototype.

At optional block 1312, the forming device 100 or a control associated with the forming device 100 can export the calculated values, or other operational data as described above, to a storage location or other device. As explained above, these values may be used by other machines, software, or operators, if desired. The method 1300 can end.

Figure 14:
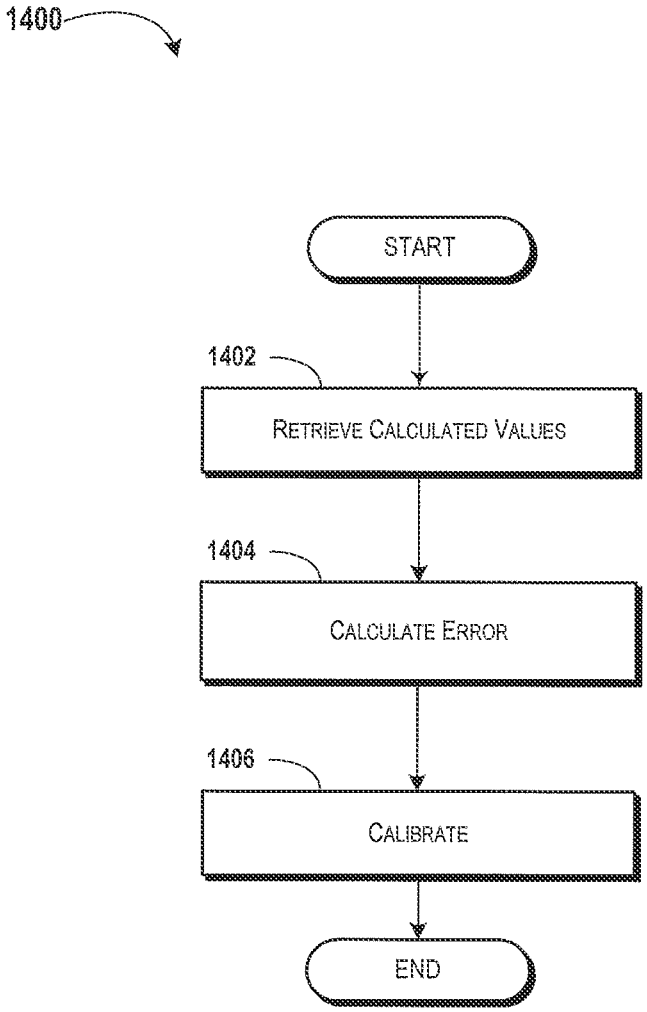
FIG. 14 schematically illustrates a method for calibrating a forming device or a component of a forming device, according to an exemplary embodiment of the present disclosure.

FIG. 14 schematically illustrates a method 1400 for calibrating a forming device 100 or a component thereof, e.g., a backgauge 210, according to an exemplary embodiment of the present disclosure. During explanation of the method 1400, the specification will refer to the forming device 100 as well as exemplary parts and tooling such as those described in FIGS. 1-13. It should be understood that the forming devices 100, parts, and tooling referred to are merely exemplary, and are used solely for the purpose of clarifying principles of the disclosed systems and method. It also should be understood that the steps of the method 1400 are not necessarily presented in any particular order and that performance of some or all the steps in an alternative order(s) is possible and is contemplated. The steps have been presented in the demonstrated order for ease of description and illustration. Steps can be added, omitted and/or performed simultaneously, without departing from the scope of the appended claims. It should also be understood that the illustrated method 1400 can be ended at any time.

Some or all steps of the method 1400, and/or substantially equivalent steps, can be performed by execution of computer-readable instructions included on a computer-readable medium, e.g., the memory 112 of the control module 108, or another storage medium associated with or located at the forming device 100. The term "computer-readable medium" and variants thereof, as used in the description and claims, can include volatile and/or non-volatile, removable and/or non-removable media such as, for example, RAM, ROM, EEPROM, flash memory or other memory technology, CD ROM, DVD, or other optical disk storage, magnetic tape, magnetic disk storage or other magnetic storage devices, or other media that can be used to store the computer-readable instructions.

The method 1400 begins with an operator or a control determining that the forming device 100 needs to be calibrated. In some embodiments, this occurs during the method 1300 described in FIG. 13, though such a determination may be made at any time. The method 1400 will be described assuming that a part has been bent and the OD's of the part indicate that the forming device 100 needs to be calibrated.

At block 1402, measured OD's and calculated values for a part are retrieved from a forming device 100, a forming device control, or another storage location associated with the forming device 100. It will be appreciated that the values may be retrieved from a network location or other remote storage device.

At block 1404, the error can be calculated. While this calculation is not restated here, the reader is encouraged to review the error calculation described above with reference to FIGS. 1-12. It should be appreciated that alternative methods for obtaining the error are possible, and are contemplated.

At block 1406, the forming device 100, a control associated with the forming device 100, the control code for the part, the backgauge 210, or other component associated with the forming device 100 can be calibrated to correct the error determined to exist in block 1404, as explained above. The method 1400 can end.

After calibrating the appropriate software or hardware, the forming device 100 can be used to produce parts with little, if any, error resulting from a lack of calibration. Similarly, the calibration method 1400 disclosed herein, as well as the additional details disclosed with reference to FIGS. 1-12, can be used to produce low-error parts with forming devices 100 that are out of calibration.

One of the advantages of systems and methods according to the present disclosure is that any error in the processes or calculations described herein, for example, in obtaining the inner radius 504, will effectively be consistently applied to the other calculations described herein. In other words, the systems and methods described herein are self-correcting in that an error in the inside radius 504, for example, will result in a slight shift in the other calculated values in proportion with the error in the inner radius 504 determination. As such, the effect of any error can be less pronounced in systems and methods made according to the present disclosure.

While the above systems and methods have described various calculations on the die plane 702, it should be understood that the die plane 702 is not the only reference point available upon which to base the various calculations disclosed herein. Additional reference points that are possible, and contemplated, the position relative to the die bed 208, the position relative to the top plane of the blank 300, i.e., ((the die plane 702)+(the material thickness $t_b$)), various reference points based upon the ram 202 or punch 204, as well as other reference points. The choice of a reference point may be made based on many considerations, but the underlying principles of the disclosure do not significantly change. As such, all such modifications are included in the scope of this specification and the appended claims.

No units of measurement have been indicated above, since the illustrated systems and methods can operate using any desired units of measurement. As such, systems and methods according to the present disclosure can use metric units, Imperial units, American customary units, English Units, British engineering units, other unit systems, combinations thereof, and the like. While the disclosed calculations have been described in decimal form, the calculations also may be computed in fractional form. It again should be noted that the figures are not necessarily to scale, and that the numbers used, calculated, and otherwise indicated herein are merely exemplary.

The law does not require and it is economically prohibitive to illustrate and teach every possible embodiment of the present claims. Hence, the above-described embodiments are merely exemplary illustrations of implementations set forth for a clear understanding of the principles of the invention. Variations, modifications, and combinations may be made to the above-described embodiments without departing from the scope of the claims. All such variations, modifications, and combinations are included herein by the scope of this disclosure and the following claims.

I claim:

1. A method comprising:

bending, by a forming device comprising a processor, a forming tool, and a die, a part blank formed from a material;

tracking, by the forming device, movement of the forming tool until the bending is completed, the movement being measured by measuring a movement of the forming tool during the bending;

determining, by the processor, a depth of a punch tip of the forming tool after the bending is completed, the depth being relative to a die plane level of the die and being calculated as a distance between the die plane level and a punch tip position of the punch tip after the bending is completed; and calculating, by the processor, a neutral axis length and a neutral axis radius of the part blank based upon the depth of the punch tip after the bending is completed.

2. The method of claim 1, wherein the calculating is further based upon a material thickness of the part blank.

3. The method of claim 1, wherein the calculating is further based upon a measured dimension of the part blank, and wherein the measured dimension is measured after the bending is completed.

4. The method of claim 1, wherein the calculating is further based upon a measured outside dimension of the part blank, and wherein the measured outside dimension is measured after the bending is completed.

5. The method of claim 1, wherein the calculating is further based upon a measured inside dimension of the part blank, and wherein the measured inside dimension is measured after the bending is completed.

6. The method of claim 1, further comprising calculating a K-factor for the material based upon the depth of the punch tip.

7. The method of claim 6, further comprising exporting the K-factor from the forming device to another device.

8. The method of claim 6, further comprising calculating a forming tool springback value.

9. The method of claim 8, further comprising calculating a springback based upon a forming tool material used to form the forming tool and a die material used to form the die.

10. The method of claim 8, wherein calculating the K-factor is further based upon the forming tool springback valve calculated.

11. A forming device comprising:

a processor;

a forming tool;

a die; and a memory that stores computer readable instructions that, when executed by the processor, cause the forming device to perform operations comprising bending a part blank formed from a material, tracking movement of the forming tool until the bending is completed, the movement being measured by measuring movement of the forming tool during the bending;

determining a depth of a punch tip of the forming tool after the bending is completed, the depth being relative to a die plane level of the die and being calculated as a distance between the die plane level and a punch tip position of the punch tip after the bending is completed; and calculating a neutral axis length and a neutral axis radius of the part blank based upon the movement of the forming tool during the bending, and that is based upon the depth of the punch tip after the bending is completed.

12. The forming device of claim 11, wherein the calculating is further based upon a material thickness of the part blank.

13. The forming device of claim 11, wherein the calculating is further based upon a measured outside dimension of the part blank, and wherein the outside dimension is measured after the bending is completed.

14. The forming device of claim 11, wherein the calculating is further based upon a measured inside dimension of the part blank, and wherein the measured inside dimension is measured after the bending is completed.

15. The forming device of claim 11, wherein the computer readable instructions, when executed by the processor, cause the forming device to calculate a K-factor for the material based upon the depth of the punch tip.

16. The forming device of claim 15, wherein the computer readable instructions, when executed by the processor, cause the forming device to export the K-factor to another device.

17. A non-transitory computer readable medium having stored thereon computer-executable instructions that, when executed by a processor, cause a forming device comprising a forming tool, a die, and the processor to perform operations comprising:

bending a part blank;

tracking a movement of the forming tool until the bending is completed, the movement being measured by measuring a movement of the forming tool during the bending;

determining a depth of a punch tip of the forming tool after the bending is completed, the depth being relative to a die plane level of the die and being calculated as a distance between the die plane level and a punch tip position of the punch tip after the bending is completed; and determining a neutral axis length and a neutral axis radius of the part blank based upon the depth of the punch tip after the bending is completed.

18. The non-transitory computer readable medium of claim 17, wherein the computer-executable instructions, when executed by the processor, cause the forming device to perform operations further comprising calculating a K-factor for a material based upon the depth of the punch tip.

19. The non-transitory computer readable medium of claim 18, wherein the K-factor is further based upon a material thickness of the part blank.

20. The non-transitory computer readable medium of claim 18, wherein the computer-executable instructions, when executed by the processor, cause the forming device to perform operations further comprising exporting the K-factor.

* * * * *